US009650799B2

(12) United States Patent
Erlich et al.

(10) Patent No.: US 9,650,799 B2
(45) Date of Patent: May 16, 2017

(54) AUTOMATED SWIMMING POOL CLEANER HAVING AN ANGLED JET DRIVE PROPULSION SYSTEM

(71) Applicant: Aqua Products, Inc., Cedar Grove, NJ (US)

(72) Inventors: Giora Erlich, North Caldwell, NJ (US); Tibor Horvath, Estero, FL (US)

(73) Assignee: AQUA PRODUCTS, INC., Cedar Grove, NJ (US)

( * ) Notice: Subject to any disclaimer, the term of this patent is extended or adjusted under 35 U.S.C. 154(b) by 0 days.

(21) Appl. No.: 14/666,145

(22) Filed: Mar. 23, 2015

(65) Prior Publication Data

US 2015/0197951 A1 Jul. 16, 2015

Related U.S. Application Data

(60) Continuation of application No. 13/545,926, filed on Jul. 10, 2012, which is a continuation of application No. 13/135,684, filed on Jul. 12, 2011, now Pat. No. 8,273,183, which is a continuation of application No. 12/924,554, filed on Sep. 28, 2010, now abandoned, (Continued)

(51) Int. Cl.
*E04H 4/16* (2006.01)

(52) U.S. Cl.
CPC ..... *E04H 4/1654* (2013.01); *E04H 4/1663* (2013.01)

(58) Field of Classification Search
CPC ..... E04H 4/16; E04H 4/1654; E04H 4/1663
See application file for complete search history.

(56) References Cited

U.S. PATENT DOCUMENTS 2,104,365 A 1/1938 Fuchs
2,146,021 A 2/1939 Lohr et al.
(Continued)

FOREIGN PATENT DOCUMENTS

CN 2293616 Y 10/1998
DE 7140569 3/1972
(Continued)

OTHER PUBLICATIONS

John A. Hankins from McDermott, Will and Emory LLP, Petition for Inter Partes Review Under 37 C.F.R. Section 42.100, 63 pages.
(Continued)

*Primary Examiner* — Randall Chin
(74) *Attorney, Agent, or Firm* — Abelman, Frayne & Schwab

(57) ABSTRACT

A self-propelled cleaning apparatus for cleaning a submerged surface of a pool or tank includes a housing having a front portion as defined by the direction of movement of the apparatus when propelled by a water jet, an opposing rear portion and adjoining side portions defining the periphery of the apparatus, and a baseplate with at least one water inlet. Rotationally-mounted supports are coupled proximate the front and rear portions of the housing to enable movement of the apparatus over the submerged surface. A water pump is configured to draw water and debris from the pool through the inlet for filtering. A stationary directional discharge conduit is in fluid communication with the pump and has at least one discharge opening through which a pressurized stream of water forming the water jet is directionally discharged at an acute angle with respect to the surface over which the apparatus is moving.

15 Claims, 15 Drawing Sheets

Related U.S. Application Data which is a division of application No. 11/606,809, filed on Nov. 29, 2006, now Pat. No. 7,827,643, which is a division of application No. 10/793,447, filed on Mar. 3, 2004, now Pat. No. 7,165,284, which is a division of application No. 10/109,689, filed on Mar. 29, 2002, now Pat. No. 6,742,613, which is a division of application No. 09/237,301, filed on Jan. 25, 1999, now Pat. No. 6,412,133.

(56) References Cited

U.S. PATENT DOCUMENTS

| | | | |
|---|---|---|---|
| 2,683,956 | A | 7/1954 | Conte |
| 2,923,954 | A | 2/1960 | Babcock |
| 2,943,418 | A | 7/1960 | Smith |
| 2,988,762 | A | 6/1961 | Babcock |
| 3,229,315 | A | 1/1966 | Watson |
| 3,261,371 | A | 7/1966 | Vernon |
| 3,291,145 | A | 12/1966 | Arneson |
| 3,321,787 | A | 5/1967 | Myers |
| 3,439,368 | A | 4/1969 | Myers |
| 3,444,575 | A | 5/1969 | Martin |
| 3,551,930 | A | 1/1971 | Myers |
| 3,689,408 | A | 9/1972 | Edmiston et al. |
| 3,822,754 | A | 7/1974 | Henkin et al. |
| 3,860,518 | A | 1/1975 | Henricksen |
| 3,871,129 | A | 3/1975 | Tong |
| 3,921,654 | A | 11/1975 | Pansini |
| 3,936,899 | A | 2/1976 | Henkin et al. |
| 3,972,339 | A | 8/1976 | Henkin et al. |
| 3,979,788 | A | 9/1976 | Strausak |
| 4,100,641 | A | 7/1978 | Pansini |
| 4,141,101 | A | 2/1979 | Gibellina |
| 4,169,484 | A | 10/1979 | Bonigut et al. |
| 4,281,995 | A | 8/1981 | Pansini |
| 4,348,192 | A | 9/1982 | Pansini |
| 4,429,429 | A | 2/1984 | Altschul |
| 4,463,520 | A | 8/1984 | Crosman |
| 4,558,479 | A | 12/1985 | Greskovics et al. |
| 4,589,986 | A | 5/1986 | Greskovics et al. |
| 4,652,366 | A | 3/1987 | Brooks |
| 4,749,478 | A | 6/1988 | Brooks |
| 4,776,954 | A | 10/1988 | Brooks |
| 4,778,599 | A | 10/1988 | Brooks |
| 4,837,886 | A | 6/1989 | Rawlins |
| 4,839,063 | A | 6/1989 | Brooks |
| 4,852,211 | A | 8/1989 | Strausak |
| 4,920,599 | A | 5/1990 | Rief |
| 5,014,912 | A | 5/1991 | Brooks |
| 5,099,535 | A | 3/1992 | Chauvier et al. |
| 5,197,158 | A | 3/1993 | Moini |
| 5,317,777 | A | 6/1994 | Stoltz |
| 5,351,355 | A | 10/1994 | Chiniara |
| 5,569,371 | A | 10/1996 | Perling |
| 5,655,246 | A | 8/1997 | Chang |
| 5,740,576 | A | 4/1998 | Sebor et al. |
| 5,896,610 | A | 4/1999 | Sebor et al. |
| 5,974,347 | A | 10/1999 | Nelson |
| 5,985,156 | A | 11/1999 | Henkin et al. |
| 6,039,886 | A | 3/2000 | Henkin et al. |
| 6,280,611 | B1 | 8/2001 | Henkin et al. |
| 6,294,084 | B1 | 9/2001 | Henkin et al. |
| 6,412,133 | B1 | 7/2002 | Erlich et al. |
| RE38,479 | E | 3/2004 | Henkin et al. |
| 7,805,792 | B2 | 10/2010 | Roumagnac |

FOREIGN PATENT DOCUMENTS

| | | | |
|---|---|---|---|
| DE | 3110203 | A | 9/1982 |
| FR | 2314334 | A1 | 1/1977 |
| FR | 2655575 | A3 | 6/1991 |
| FR | 2685374 | B1 | 6/1993 |
| JP | 54003376 | A | 1/1979 |
| JP | 54009457 | A | 1/1979 |
| JP | 54015365 | A | 2/1979 |
| JP | 54045971 | A | 4/1979 |
| JP | 54045972 | A | 4/1979 |
| JP | 54050157 | A | 4/1979 |
| JP | 54056251 | A | 5/1979 |
| JP | H08004337 | A | 1/1996 |

OTHER PUBLICATIONS

McNamara, B.J., Elleru, R.G., Arpin, J.B., Case IPR2013-00159 (BJM) U.S. Pat. No. 8,273,183 B2 Decision, *Zodiac Pool Systems, Inc.* vs. *Aqua Products, Inc.*, United States Patent and Trademark Office Before the Patent Trial and Appeal Board, Paper 18, Aug. 23, 2013, 35 pages.

McNamara, B.J., Elleru, R.G., Arpin, J.B., Case IPR2013-00159 (BJM) U.S. Pat. No. 8,273,183 B2 Final Written Decision, *Zodiac Pool Systems, Inc.* vs. *Aqua Products, Inc.*, United States Patent and Trademark Office Before the Patent and Trial Appeal Board, Paper 71, Aug. 22, 2014, 57 pages.

EPO Office Letter/Search Report Apr. 23, 2001.

Decision of Appeal from the United States Patent and Trademark Office, Patent Trial and Appeal Board in No. IPR2013-00159, decided May 25, 2016, for U.S. Pat. No. 8,273,183.

Decision on Petition for Rehearing from the United States Patent and Trademark Office, Patent Trial and Appeal Board in No. IPR2013-00159, decided Aug. 12, 2016, for U.S. Pat. No. 8,273,183.

FIG.45
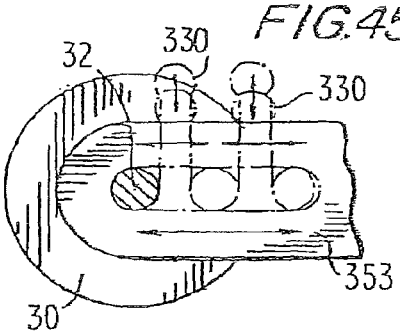
FIG.46
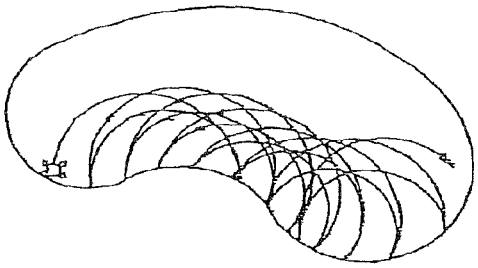
FIG.47
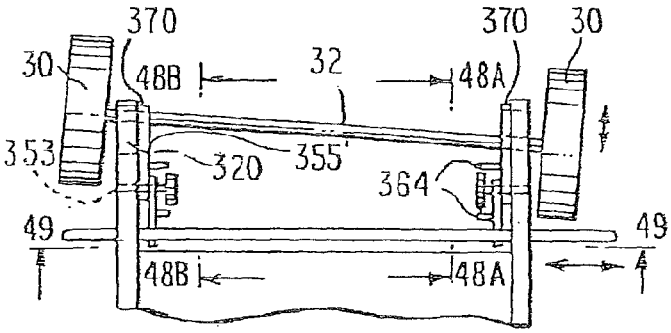
FIG.48A
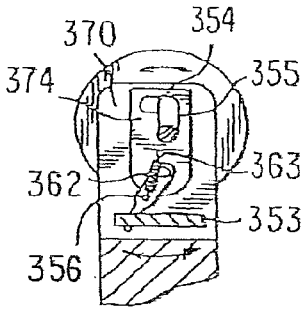
FIG.48B
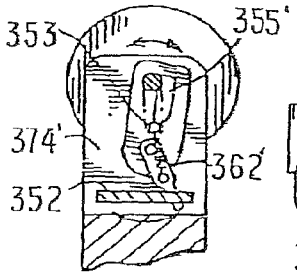
FIG.49
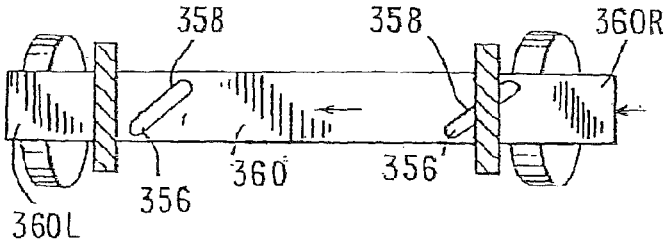
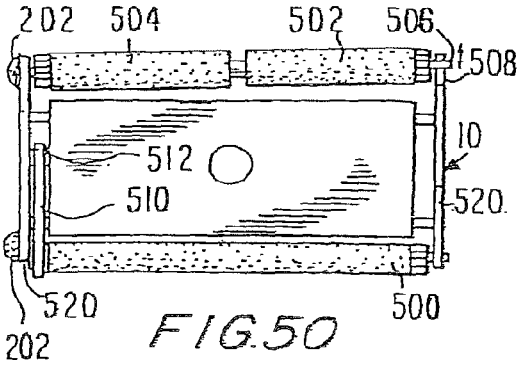
FIG.50
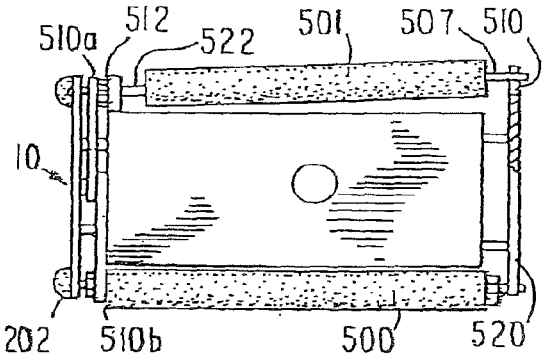
FIG.51

AUTOMATED SWIMMING POOL CLEANER HAVING AN ANGLED JET DRIVE PROPULSION SYSTEM

CROSS REFERENCES TO RELATED APPLICATIONS

This application is a continuation of U.S. application Ser. No. 13/545,926, filed Jul. 10, 2012, now pending, which is a continuation of U.S. application Ser. No. 13/135,684, filed Jul. 12, 2011, now U.S. Pat. No. 8,273,183, which is a continuation of application Ser. No. 12/924,554, filed Sep. 28, 2010, which is a divisional of application Ser. No. 11/606,809, filed Nov. 29, 2006, now U.S. Pat. No. 7,827,643, which is a divisional of application Ser. No. 10/793,447, filed Mar. 3, 2004, now U.S. Pat. No. 7,165,284, which is a divisional of application Ser. No. 10/109,689, filed Mar. 29, 2002, now U.S. Pat. No. 6,742,613, which is a divisional of U.S. application Ser. No. 09/237,301 filed Jan. 25, 1999, now U.S. Pat. No. 6,412,133, the disclosures of which are incorporated herein by reference in their entireties.

FIELD OF THE INVENTION

The invention relates to methods and apparatus for propelling automated or robotic swimming pool and tank cleaners and for controlling the scanning or traversing patterns of the automated cleaners with respect to the bottom and sidewalls of the pool or tank.

BACKGROUND OF THE INVENTION

Automated or robotic swimming pool cleaners traditionally contact and move about on the pool surfaces being cleaned on axle-mounted wheels or on endless tracks that are powered by a separate drive motor through a gear train. The wheels or tracks are aligned with the longitudinal axis of the cleaner. Swimming pool cleaning robots that move on wheels generally have two electric motors—a pump motor powers a water pump that is used to dislodge and/or vacuum debris up into a filter; the drive motor is used to propel the robot over the surfaces of the pool that are to be cleaned. The drive motor can be connected through a gear train directly to one or more wheels or axles, or through a belt and pulleys to propel the cleaner; or to a water pump, which can be external to the robotic cleaner that produces a pressurized stream, or water jet, that moves the cleaning apparatus by reactive force or by driving a water turbine connected via a gear train to the wheels or endless track. The movement of the pool cleaners of the prior art, when powered by either the turbine or the direct or reactive jet is in one direction and the movement is random.

Control of the longitudinal directional movement of the robot can be accomplished by elaborate electronic circuitry, as is the case when stepper and D.C. brushless motors are employed. Other control systems require the cleaner to climb the vertical sidewall of the pool until a portion of the cleaner extends above the waterline and/or the unit has moved laterally along the sidewall, after which the motor drive reverses and the cleaner returns to the bottom surface of the pool along a different path. The water powered cleaners of the prior art also rely on the reorientation of the cleaner while on contact with the wall to effect a random change in direction. However, under certain circumstances; it is a waste of time, energy and produces unnecessary wear and tear to have the robotic cleaner climb the sidewall solely for purpose of changing the pattern of movement of the cleaner.

It is known from U.S. Pat. No. 2,988,762 to provide laterally offset fixed bumper elements at each end of the cleaner to contact the facing sidewall and provide a pivot point as the cleaner approaches the wall. Another transverse slide rod can be provided to contact a side wall and causes the drive motor to reverse. The bumper elements are adjustable to provide variable angles. A third slide rod attached to a shut-off switch extends outboard of side facing the far end of the pool, so that when the cleaner has covered the entire length of the pool and approaches the wall is a generally parallel path, the third slide rod is pushed inboard and shuts off power to the unit.

It has also been proposed to direct the scanning movement of a pool cleaner mechanically by use of a three-wheeled array in which the third wheel is mounted centrally and opposite the other pair of wheels, and the axle upon which the third wheel is mounted is able to rotate in a horizontal plane around a vertical axis. A so-called free-wheeling version of this apparatus is shown on U.S. Pat. No. 3,979,788.

In U.S. Pat. No. 3,229,315, the third wheel is mounted in a plate and the plate is engaged by a gear mechanism that positively rotates the horizontal axle and determines the directional changes in the orientation of the third wheel.

It is also known in the prior art to provide a pool cleaner with a vertical plunger or piston that can be moved by a hydraulic force into contact with the bottom of the pool to cause the cleaner to pivot and change direction. The timing must be controlled by a pre-programmed integrated circuit ("IC") device.

It is also known from U.S. Pat. No. 4,348,192 to equip the feed water hose of a circular floating pool cleaning device with a continuous discharge water jet nozzle that randomly reorients itself to a reversing direction when the forward movement of the floating cleaner is impeded. In addition to the movable water jet discharge nozzle attached to the underside of the floating cleaner, the hose is equipped with a plurality of rearwardly-facing jet nozzles that move the water hose in a random pattern and facilitate movement of the cleaner.

Commercial pool cleaners of the prior art that employ pressurized water to effect random movement have also been equipped with so-called "back-up" valves that periodically interrupt and divert the flow of water to the cleaner and discharge it through a valve that has jets facing upstream, thereby creating a reactive force to move the hose and, perhaps, the attached cleaner in a generally backward direction. The back-up valve can be actuated by the flow of water through a fitting attached to the hose. The movement resulting from the activation of the back-up valve jets is also random and may have no effect on reorienting a cleaner that has become immobilized.

The apparatus of the prior art for use in propelling and directing the scanning movement of automated robotic pool cleaners is lacking in several important aspects. For example, the present state-of-the-art machines employ pre-programmed, integrated circuit ("IC") devices that provide a specific predetermined scanning pattern. The design and production of these IC devices is relatively expensive and the scanning patterns produced have been found to be ineffective in pools having irregular configurations and/or obstructions built into their bottoms or sidewalls.

Cleaners propelled by a water jet discharge move only in a generally forward direct, and their movement is random, such randomness being accentuated by equipping the unit with a flexible hose or tail that whips about erratically to alter the direction of the cleaner.

Cleaners equipped with gear trains for driving wheels or endless tracks represent an additional expense in the design, manufacture and assembly of numerous small, precision-fit parts; the owner or operator of the apparatus will also incur the time and expense of maintaining and securing replacement parts due to wear and tear during the life of the machine. A cleaning apparatus constructed with a pivotable third wheel that operates in a random fashion or in accordance with a program has the same drawbacks associated with the production, assembly and maintenance of numerous small moving parts.

The robotic pool cleaners of the prior art are also lacking in mechanical control means for the on-site adjustment of the scanning patterns of the apparatus with respect to the specific configuration of the pool being cleaned.

Another significant deficiency in the design and operation of the pool cleaners of the prior art is their tendency to become immobilized, e.g., in sharp corners, on steps, or even in the skimmer intake openings at the surface of the pool.

It is therefore a principal object of this invention to provide an improved automated or robotic pool and tank cleaning apparatus that incorporates a reliable mechanism and method of providing propulsion using a directional water jet for moving the cleaner in opposite directions along, or with respect to, the longitudinal axis of the apparatus.

It is another object of this invention to provide a method and apparatus for adjustably varying the direction of, and the amount of thrust or force produced by a water jet employed to propel a pool or tank cleaning apparatus, and to effect change in direction by interrupting the flow of water.

It is another important object of the invention to provide a simple and reliable apparatus and method for adjustably controlling the direction of discharge of a propelling water jet that can be utilized by home owners and pool maintenance personnel at the pool site to attain proper scanning patterns in order to clean the entire submerged bottom and side wall surfaces of the pool, regardless of the configuration of the pool and the presence of apparent obstacles.

A further object of the invention is to provide an improved apparatus and method for varying the position of one or more of the wheels or other support means of the cleaner in order to vary the directional movement and scanning patterns of the apparatus with respect to the bottom surface of the pool or tank being cleaned.

It is another object of the invention to provide a novel method and apparatus for periodically changing the direction of movement of a pool cleaner by intermittently establishing at least one fixed pivot point and axis of rotation with respect to the longitudinal axis of the cleaner for at least one pair of supporting wheels Another object of the present invention is to provide a method and apparatus for assuring the free and unimpaired movement of the pool cleaner in its prescribed or random scanning of the surfaces to be cleaned without interference from the electrical power cord that is attached to the cleaner housing and floats on the surface of the pool.

Yet another object of the invention is to free a pool cleaner that has been immobilized by an obstacle so that it can resume its predetermined scanning pattern.

It is also an object to provide magnetic and infrared ("IR") sensing means for controlling the power circuits for the propulsion means of the cleaner.

Another important object of the invention is to provide an economical and reliable pool cleaner with a minimum number of moving parts and no internal pump and electric motor that can be powered by the discharge stream from the pool filter system or an external booster pump and which can reverse its direction.

Another important object of this invention is to provide an apparatus and method that meets the above objectives in a more cost-effective, reliable and simplified manner than is available through the practices and teachings of the prior art.

SUMMARY OF THE INVENTION

The above objects are met by the embodiments of the apparatus and methods described below. In the description that follows, it will be understood that cleaner moves on supporting wheels, rollers or tracks that are aligned with the longitudinal axis of the cleaner body when it moves in a straight line. References to the front or forward end of the cleaner will be relative to its then-direction of movement.

In a first preferred embodiment, a directionally controlled water jet is the means that causes the translational movement of the robotic cleaner across the surface to be cleaned. In a preferred embodiment, the water is drawn from beneath the apparatus and passed through at least one filter medium to remove debris and is forced by a pump through a directional discharge conduit whose axis is aligned with the longitudinal axis of the pool cleaner. The resulting or reactive force of the discharged water jet propels the cleaner in the opposite direction. The water jet can be diverted by various means and/or divided into two or more streams that produce resultant force vectors that also affect the position and direction of movement of the cleaner.

In one preferred embodiment, a diverter or deflector means, such as a flap valve assembly, is interposed between the pump outlet and the discharge conduit, which diverter means controls the direction of movement of the water through one or the other of the opposing ends of the discharge conduit. The positioning of the diverter means, and therefore the direction of travel of the cleaner, can be changed when the unit reaches a sidewall of the pool or after the cleaner has ascended a vertical sidewall. The movement of the diverter means can be in response to application of a mechanical force, such as a lever or slide bar that is caused to move when it contacts a vertical wall, and through a directly applied force or by way of a linkage repositions the diverter means and changes the direction of the discharged, water jet to propel the cleaner away from the wall. In one preferred embodiment, power to the pump motor is interrupted and the position of the diverter means is changed in response to the change in hydrodynamic forces acting on the flap valve assembly. Mechanical biasing and locking means are also provided to assure the proper repositioning and seating of the flap valve.

The orientation of the discharged water jet can be varied to provide a downward component or force vector, lateral components, or a combination of such components or force vectors to complement the translational force.

In its broadest construction, the invention comprehends a method of propelling a pool or tank cleaner by means of a water jet that is discharged in at least a first and second direction that result in movement in opposite translational directions. The direction of the water jet is controlled by the predetermined orientation of a discharge conduit that is either stationary or movable with respect to the body of the cleaner. The discharge conduit can be fixed and the pressurized water controlled by one or more valves that operate in one or more conduits to pass the water for discharge in alternating directions. The discharge conduit can also comprise an element of a rotating turret that is preferably mounted on the top wall of the cleaner housing and is caused to rotate between at least two alternating opposed positions in order to propel the cleaner in a first and then a second generally opposite direction. The means for rotating the turret and discharge conduit can include spring biasing means, a motor or water turbine driven gear train, etc. During the change from one position to the alternate opposing position, the cleaner is stabilized by interrupting the flow of water from the discharge conduit, as by interrupting the power to the pump motor or discharging water from one or more other orifices The invention comprehends methods and apparatus for controlling the movement of robotic tank and swimming pool cleaners that can be characterized as systematic scanning patterns, scalloped or curvilinear patterns and controlled random motions with respect to the bottom surface of the pool or tank. For the purposes of this description, references to the front and rear of the cleaning apparatus or its housing will be with respect to the direction of its movement. A conventional pool cleaner comprises a base plate on which are mounted a pump, at least one motor for driving the pump and optionally a second motor for propelling the apparatus via wheels or endless track belts; a housing having a top and depending sidewalls that encloses the pump and motor(s) is secured to the base plate; one or more types of filter media are positioned internally and/or externally with respect to the housing; and a separate external handle is optionally secured to the housing. Power is supplied by floating electrical cables attached to an external source, such as a transformer or a battery contained in a floating housing at the surface of the pool; pressurized water can also be provided via a hose for water turbine-powered cleaners. The invention also has application to tank and pool cleaners which operate in conjunction with a remote pump and/or filter system which is located outside of the pool and in fluid communication with the cleaner via a hose.

While the illustrative figures which accompany this application, and to which reference is made herein, schematically illustrate various embodiments of the invention on robotic cleaners equipped with wheels, it will be understood by one of ordinary skill in the art that the invention is equally applicable to cleaners which move on endless tracks or belts. Specific examples are also provided where the cleaner is equipped with power-driven transverse cylindrical rollers that extend across the width of the cleaner body.

In one embodiment of this aspect of the invention, an otherwise conventional cleaner is provided with at least one wheel or track that projects beyond the periphery of the apparatus in a direction of movement of the apparatus. In operation, this offset projecting wheel will contact the wall to stop the forward movement of the apparatus on one side thereby causing the cleaner to pivot until the opposite side makes contact with the wall so that the longitudinal axis of the cleaner forms an angle "b" with the sidewall of the pool. When the cleaner moves in the reverse direction away from the wall, it will be traversing the bottom of the pool at an angle "b". An apparatus equipped with only one projecting wheel or supporting member at one corner location of the housing will assume a generally normal position to an opposite parallel sidewall.

In a further preferred embodiment, a cleaner provided with a second projecting wheel or supporting member at the opposite end will undergo a pivoting motion as the cleaner approaches a wall in either direction of movement. The angle "b" can be varied or adjusted by changing the distance the wheel projects beyond the periphery of the cleaner. As will be appreciated by one of ordinary skill in the art, the angle "b" will determine the cleaning pattern, which pattern in turn will relate to the size and shape of the pool, the degree of overlap on consecutive passes along the surface to be cleaned, and other customary parameters.

In order to change the direction of movement when the cleaner assumes a path that is generally parallel to an end wall of the pool, the cleaner is provided with at least one side projecting member that extends outwardly from the cleaner housing from a position that can range from at or adjacent the forward end to midway between the drive wheels or ends of the cleaner. The side projecting member acts as a pivot point when contacting a sidewall of the pool so that the cleaner assumes an arcuate path until it engages the contact wall. When the unit reverses, the new cleaning pattern is initially at approximately a right angle to the former scanning pattern. In another embodiment of the invention, a pair of the wheels located at one or both ends of the cleaner are mounted for rotation at an angle that is not at 90 degrees or normal to the longitudinal axis of the cleaner. Where the pairs of front and rear wheels are each mounted on a single transverse axle, one or both of the axles is mounted at an angle that is offset from the longitudinal normal by an angle "b". In another preferred embodiment, one side of the axle is mounted in a slot that permits movement to either the front or rear, or to both front and rear, in response to movement of the apparatus in the opposite direction.

In yet another embodiment, at least one wheel of a diameter smaller than the other wheels is mounted on an axle to induce the apparatus to follow a curved path. In another embodiment, the apparatus is provided with at least one pair of caster or swivel-mounted wheels, the axes of which independently pivot in response to changes in direction so that the apparatus follows a curved path in one or both directions. In this embodiment, providing the apparatus with two pairs of caster-mounted wheels will produce a scalloped or accentuated curvilinear motion as the unit moves from one point of engagement with the vertical sidewalls to another.

In a further preferred embodiment of the slot-mounted axle, one or more position pins are provided to fix and/or change the range of movement of the axle in the slot. These adjustments allow the operator to customize the pattern based upon the size and/or configuration of the specific pool being cleaned.

Another embodiment of the invention improves the ability of the cleaner to follow a particular pattern of scanning without interference or immobilization by providing an improved connector for the power cable. A swivel or rotating electrical connector is provided between the cleaner and the external power cord in order to reduce or eliminate interference with the scanning pattern caused by twisting and coiling of the power cord as the cleaner changes direction. The swivel connector can have two or more conductors and be formed in a right-angle or straight configuration, and is provided with a water-tight seal and releasable locking means to retain the two ends rotatably joined against the forces applied during operation of the cleaner.

In another embodiment of the invention, control means are provided to periodically reverse the propelling means to assure that the cleaner does not become immobilized, e.g., by an obstacle in the pool. If the pool cleaner does not change its orientation with respect to the bottom or sidewall as indicated by a signal from the mercury switch indicating that such transition has occurred during the prescribed period, e.g., three minutes, the control circuit will automatically change the direction of the drive means in order to permit the cleaner to move away from the obstacle and resume its scanning pattern. In a preferred embodiment of the invention, the predetermined delay period between auto-reversal sequences is adjustable by the user in the event that a greater or lesser delay cycle time is desired. Sensors, such as magnetic and infrared responsive devices are provided to change the direction of movement in response to prescribed conditions.

BRIEF DESCRIPTION OF THE DRAWINGS

The above objects and other advantages and benefits of the invention will be apparent from the following description in which:

FIG. 45 is a side elevation view of an adjustable axle and wheel assembly similar to the embodiments illustrated in FIGS. 43 and 44;

FIG. 46 is a plan view of a curvilinear or free-form pool or tank schematically illustrating the predetermined scanning pattern in accordance with one embodiment of the invention;

FIG. 47 is a bottom plan view of one end of a pool cleaner wheel and axle assembly illustrating a mechanism for automatically changing the orientation of the wheels in response to a lateral contact with the side wall of a pool;

FIG. 48A is a sectional view of the wheel and mechanism taken along line AA of FIG. 47;

FIG. 48B is a sectional view of the opposite wheel and mechanism taken along line B-B of FIG. 47;

FIG. 49 is a sectional view taken along a line 49-49 of FIG. 47;

FIG. 50 is atop plan view of a cleaner equipped with motor-driven supporting rollers on a moving axle in accordance with the invention;

FIG. 51 is a top plan view having supporting rollers and a sliding axle in accordance with the invention that includes a universal joint.

DESCRIPTION OF THE PREFERRED EMBODIMENTS

Figure 1:
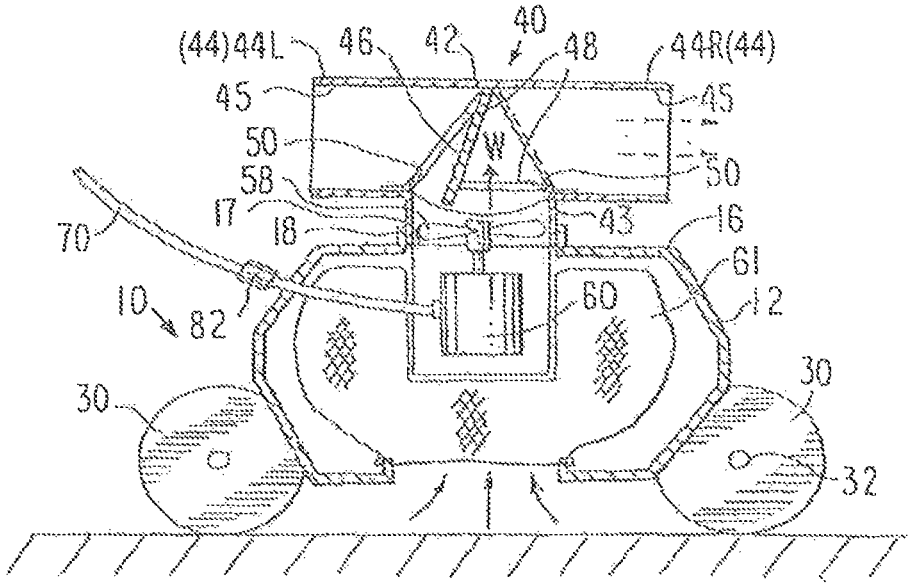
FIG. 1 is a side elevation, partly in cross-section, of a pool cleaner illustrating one embodiment of the directional water jet of the invention.

In the description that follows, a pool cleaner 10 has an exterior cover or housing 12 with a top wall 16, an internal pump and drive motor 60 that draws water and debris through openings in a base plate that are entrained by a filter 61.

The series of FIGS. 1-14 illustrate embodiments in which a single motor is used to vacuum debris and propel a swimming pool cleaning robot in combination with mechanically simple directional control means. In this embodiment, a temporary interruption of power to the motor will result in the reversal of the robot's movement. The interruption of power to the motor can result from a programmable power control circuit or be initiated by physical conditions affecting the cleaner.

Figure 6:
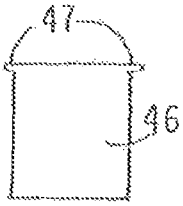
FIG. 6 is a top plan view of a flap valve member suitable for use with the embodiment of FIG. 1.
Figure 7:
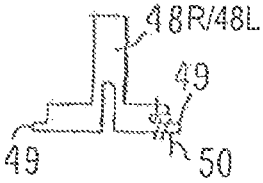
FIG. 7 is a top plan view of a flap valve assembly locking bar.

FIG. 1 schematically illustrates, in partial cross-section, a pool cleaner 10 having a water jet valve assembly 40 forming a pump outlet that is mounted on top of a motor-driven water pump 60 and using impeller 58 to drive water "W" up through housing aperture 17 and into the valve assembly. The valve assembly 40 comprises a generally T-shaped valve housing 42 with depending leg 43 having a first end that is secured to cleaner housing flange 18, and a second end that is in fluid communication with discharge conduits 44R and 44L. Positioned in the interior of valve housing 42 is flap valve member, or diverter, 46 (shown in a transitory position). As best shown in FIGS. 6 and 7, flap 46 is provided with mounting posts 47, and two "T"-shaped spring-loaded lock bars 48R and 48L pivotally mounted on pivot posts 49 on either side of the flap 46. Lock springs 50 urge bars 48 into contact with flap member 46. The cross-section of conduits 44 can be round, rectilinear, or of any other convenient shape, the rectangular configuration illustrated being preferred.

Figure 2:
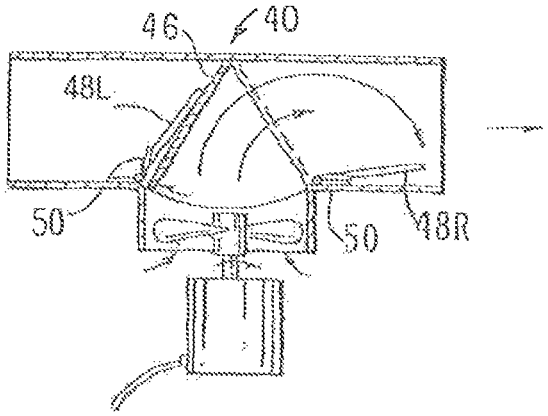
FIGS. 2 and 3 are side elevation views, partly in cross-section, schematically illustrating the operation of the water jet valve assembly shown in FIG. 1.

FIG. 2 illustrates the sequence of movements inside valve housing 42. When power to the pump motor 60 is turned on, the water being pumped through jet valve housing 42 is a pressurized water stream W, which enters the housing and acts on the flap member 46 to urge it into a first position to close discharge conduit 44L at the left side of the valve. The pressurized water stream W also applies a force that urges the lock bar 48R to fold away from the valve member 46 in the right discharge conduit 44R, resulting in a water jet propulsion force that is emitted from the right end of discharge conduit 44R.

Figure 3:
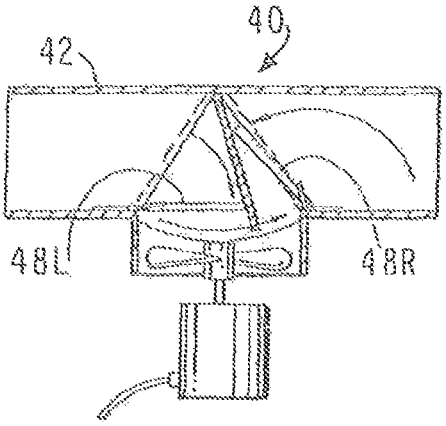

FIG. 3 illustrates the next sequence of steps or movements that result when power to the motor 60 is shut off and/or the flow of water W is interrupted. The sudden interruption of the water W flowing into the valve housing 42 causes the exiting water stream to create a low pressure or partial vacuum in the pump outlet, thereby causing flap member 46 to swing to the transitory (i.e., second) position over the pump outlet and towards the right discharge conduit. This movement of the flap member is followed by the movement of left lock bar 48L to lock the valve member 46 into position to the right of center. When power to the motor is turned back on, a second high pressure water stream is formed within the pump outlet that moves the diverter to a third position to close the right discharge conduit 44R, and the water flow will be directed into left discharge conduit 44L. It is possible to operate the jet valve assembly 40 without lock bars 48L and 48R; however, precise timing is required to turn the power on and to reactivate the pump 60 before valve member 46 swings back to its previous position prior to the interruption of the water flow.

Figure 4:
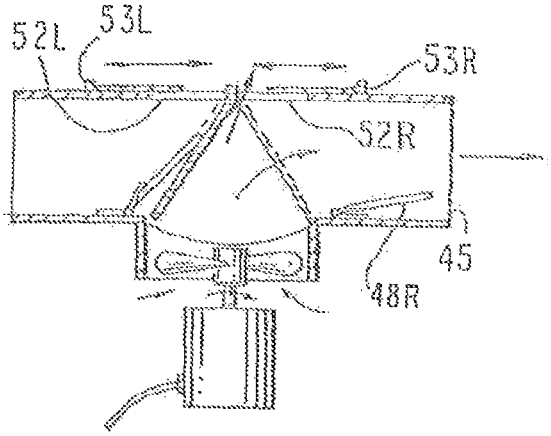
FIGS. 4 and 5 are side elevation views of the embodiments of the valve assembly of FIGS. 2 and 3 provided with additional vertical discharge valves of the invention.

FIG. 4 illustrates a further preferred embodiment in which provision is made for a reduction of excessive water jet pressure through the open end 45 of conduits 44R and 44L. To control and adjust the water pressure, openings are provided at both sides of flap valve 46, and adjustable closures, which can be e.g., sliding 53R, 53L doors proximate the openings provide for the desired amount of by-pass water the force of which, when directed upward, urges the robot 10 against the surface of the pool.

Figure 5:
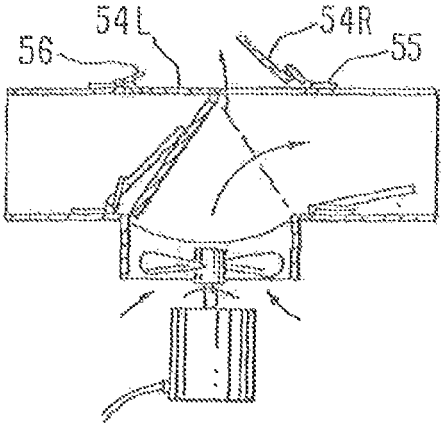

FIG. 5 illustrates an automatic mechanism to accomplish the above in which spring-loaded doors 54R, 54L open when the initial operating pressure is too high to maintain proper speed of robot, e.g., when the filter bag is clean. Doors 54 are mounted by hinged members 55 and biased into a closed position by springs 56. As filter 61 accumulates debris and dirt, the bag clogs up, pressure drops and the spring-loaded doors close partially or completely.

FIG. 6 illustrates the configuration of a preferred embodiment of the flap valve member 46 and FIG. 7 shows one embodiment of the lock bar 48 and the relation of associated lock spring 50. Other forms of biased mechanisms, including electronic and electromechanical means can be employed.

Figure 1A:
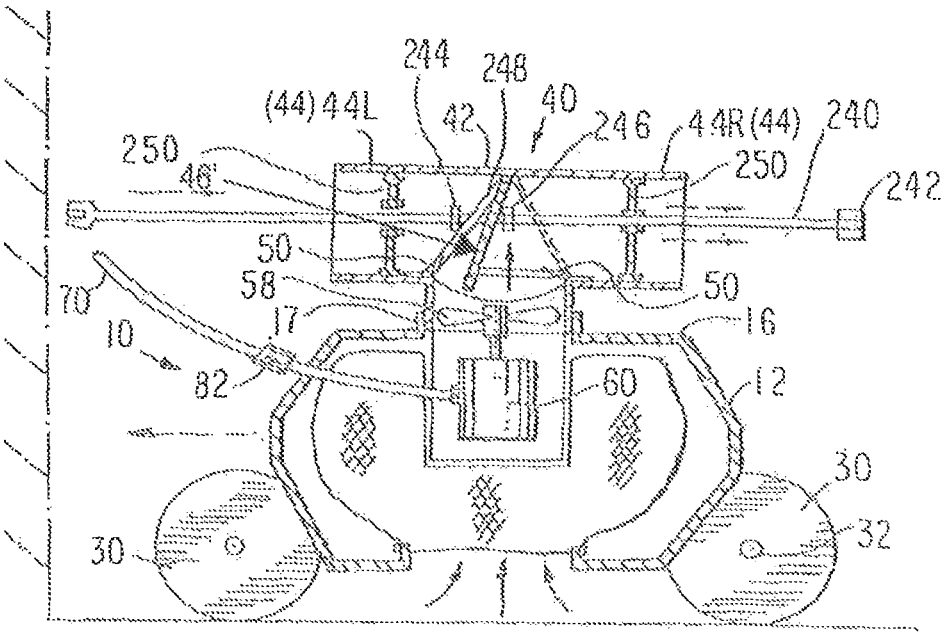
FIG. 1A is a side elevation, partly in cross-section of another embodiment of the invention of FIG. 1.

In another preferred embodiment of the invention, the flap 46 is moved by positive mechanical means in response to a contact with a side wall or other structure in the pool. For example, FIG. 1A illustrate a cleaner 10, similar in construction to that of FIG. 1, on which is mounted valve assembly 40'. Valve actuating member 240, is slidably mounted internally and parallel to the axis of the discharge conduits 44 in spiders 250 and passes through a slotted opening 248 in flap member 46', Contact members 244 and 246 are mounted on rod member 240 on either side of flap member 46' and positioned to urge the valve into one or the other of its sealing positions to divert the water flow W. In operation, as the cleaner 10 approaches the sidewall, resilient tip member 242 contacts the wall and rod 240 is moved to the left in FIG. 1A until contact member 244 reaches flap 46' and moves it to the right. When lefthand wheel 30 reaches the wall, the movement of rod 240 ceases and flap 46' is seated. With water W exiting discharge conduit 44L, the cleaner moves away from the wall with actuating rod 240 extending beyond the periphery of the cleaner and positioned to contact the opposite wall, where the process is repeated.

Figure 1B:
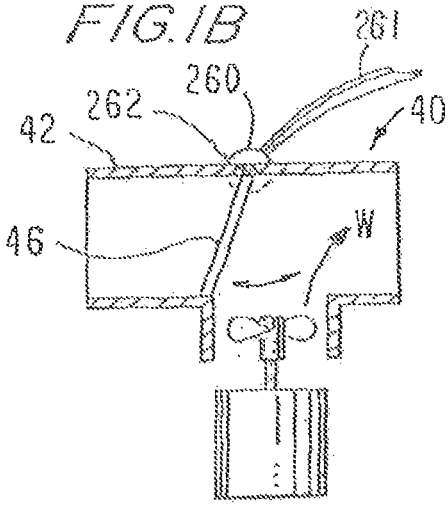
FIG. 1B is a side elevation, partly in cross-section, of a water jet valve assembly schematically illustrating another embodiment of the invention of FIG. 1.

In another preferred embodiment, the flap 46 is moved by electro-mechanical means, e.g., a linear or circular solenoid. As schematically illustrated in FIG. 1B, a circular solidoid 260 having power cord 261 is mounted on the exterior of valve housing 42. The axially rotating element 262 of solenoid 260 engages flap 46. In one preferred embodiment, the IC controller for the cleaner sends a signal to activate the solenoid moving the flap 46 to its opposing position. It will be understood that the force of water stream W will seat flap 46 in the reversing position.

Figure 8:
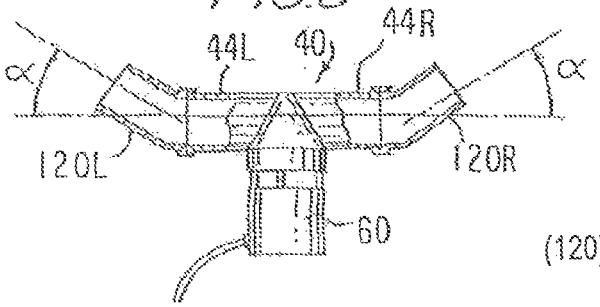
FIG. 8 is a side elevation, partly in cross-section, of the valve assembly of the invention installed on a pump.

FIG. 8 illustrates the jet valve assembly as described in FIGS. 1-3 on which additional directional flow elbows 120R, 120L are secured to the terminal ends of the discharge conduits 44R, 44L. The assembly 40 can be produced with elbows 120 as an integral unit from molded plastic, cast aluminum or other appropriate materials.

The water jet discharged from the elbow 120 at an angle "a" to the translational plane of movement of the cleaner 10 produces a force vector component in a downward direction towards the wheels 30 as well as a translational force vector tending to move the cleaner across the surface being cleaned.

Figure 9:
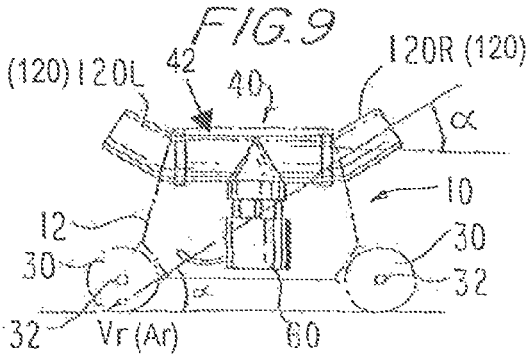
FIG. 9 is a side elevation of the embodiment of FIG. 8, schematically illustrated in relation to a pool cleaner, shown in phantom.

FIG. 9 illustrates the especially preferred location and orientation of the jet valve assembly 40 of FIG. 8 in relation to robotic cleaner 10 (shown in phantom.) In this embodiment, the discharge conduits 44, through their associated elbows 120, project through the sidewalls of housing 12. In a further preferred embodiment, the elbows and valve housing 42 are integrated into the molded housing 12 which is produced from an impact resistant polymer. With further reference to the arrow "VR" indicates the resultant vector force produced by the expelled jet stream, the angle "a" of which is critical to the proper movement of robot 10 while on or off the vertical or angled side wall of a pool. As shown in FIG. 9, the projected resultant vector "Ar" crosses the horizontal or translational plane between the axles 32, and preferably in closer proximity to the front axle, where the front axle is defined by the direction of robot's movement as the leading axle. Providing an angle that places the line of resultant vector "Ar" between the axles assures the stable operation of the cleaner.

In addition to providing a more compact and damage resistant construction, incorporation of discharge valve 40 into housing 12 reduces the number of separate parts required for the practice of the invention, thereby reducing costs. In this regard, use of a source of pressurized water from external source as specifically illustrated in FIGS. 12-14 (and which can be applied to all of the other embodiments described) eliminates the pump and motor assembly 60 resulting in further cost and material savings, as well as a reduction in operating and maintenance expenses. Moreover, by incorporating the valve assembly 40 in the interior of housing 12, other elements conventionally attached to the exterior of cleaners of the prior art can continue to be used, e.g., floating handles that control the alignment of the unit on the sidewall at the water line of the pool.

Figure 10:
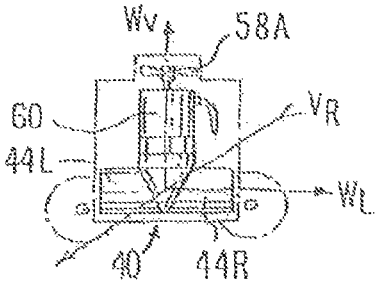
FIG. 10 is a side elevation of another embodiment of the water jet valve assembly of the invention schematically illustrated in relation to a cleaner, shown in phantom.

FIG. 10 illustrates a jet valve assembly similar to that of FIGS. 1-3 that is mounted upside down in a robotic cleaner (shown in phantom). In this embodiment the motor operates two propellers, one located at either end of the drive shaft. The upper propeller 58A creates a downward force, which when coupled with the horizontal or translational jet force emitted from discharge conduit 44R or 44L produces a resultant vector R ($V_R$) that can be set in the proper angle by selecting the appropriate size for the upper propeller. In this embodiment, directional elbows are not required to provide a downward hydrodynamic force vector to urge the apparatus into contact with the surface to be cleaned.

Figure 11:
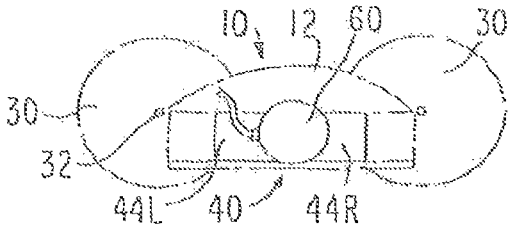
FIG. 11 is a side elevation of another embodiment of the water jet valve assembly of the invention schematically illustrated in relation to a cleaner, shown in phantom.

FIG. 11 illustrates a jet valve assembly 40 that is mounted in cleaner 10 in a horizontal position, permitting a low profile for the cleaner housing 12. In the embodiment shown, the housing 12 is supported by large diameter wheels 30 and the axles 32 are positioned above valve assembly 40. As a result of the low center of gravity of the unit the discharge of the propelling force of the water jet can be limited to the horizontal or translational direction. The large wheel diameter allows the unit to traverse uneven surfaces.

Figure 12:
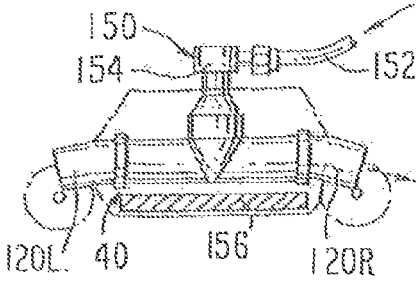
FIG. 12 is a side elevation of another embodiment of the water jet valve assembly of the invention with pressurized water supplied by an external source, schematically illustrated in relation to a cleaner, shown in phantom.

FIG. 12 illustrates a jet valve assembly 40 which is connected to an external pump (not shown) by a flexible hose 152 attached to housing adapter 150 and therefore requires no internal pump motor. The hose 152 is secured to the robotic cleaning apparatus by means of a housing adapter 150 forming a discharge outlet (e.g., a swiveling elbow joint) 154 to allow unimpeded movement of the robotic cleaner and to prevent twisting of the hose 152. The housing adapter 150 is tubular and includes the discharge outlet 154 for discharging a pressurized stream of water from the external pump into the jet valve assembly 40. The jet valve assembly 40 directs the pressurized stream of water through one of the opposing ends (i.e., openings) of the directional conduit 44 to propel the cleaner in a forward direction. The switching of jet valve is accomplished by a solenoid valve (not shown) installed in-line near the external pump. Cleaners using this external pump system do not have filter bags to collect debris. Rather, the jet outlet is deflected slightly downward toward the surface being cleaned by directional flow elbows 120R, 120L so that the water jet turbulence stirs up the debris from the bottom or submerged surface of the pool or tank; once buoyant, the debris is filtered by the pool's permanent internal filter system. Generally, outside filtering systems have multiple inlets to the pool, one of them usually is equipped with a fitting so that flexible hose 152 can be connected to it. Utilizing this embodiment of the invention, an outside filter system becomes much more efficient since it is able to filter not only floating debris from the water's surface, but also debris dislodged from the bottom or submerged surface of the pool or tank. To assure the downward directed jet streams do not flip the cleaner, supplemental weight member 156 is added to the bottom of the apparatus to maintain an overall negative buoyancy. The weight member can be one or more batteries for providing power to cleaner 10 where the pump is powered by an internal motor, as in FIGS. 1-11.

Figure 12A:
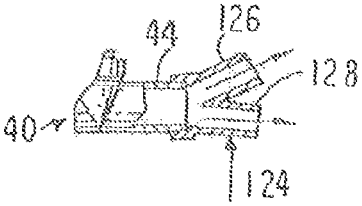
FIG. 12A is aside elevation view, partly in cross-section, of a modified discharge conduit attachment in accordance with the invention.

FIG. 12A illustrates a bi-axial flow diverter 124 attached to discharge conduit 44 for use with the robot of FIG. 12. It is desirable for ease of handling not to add additional weight to the cleaner. Instead of adding weight 156 (as shown in FIG. 12), each opposing end or opening of the discharge conduit 44 in this embodiment is provided with flow diverted with at least two channels 126 and 128 shaped so that part of the emitted water is directed downward at a relatively shallow angle via the first channel 128, while the other portion of the stream is directed upwardly at greater angle to the translational plane via the second channel 126. The combined force of the two streams results in a vector R (see, e.g., vector $V_R$ of FIG. 10) that urges the robot against the surface on which it is moving.

Figure 13:
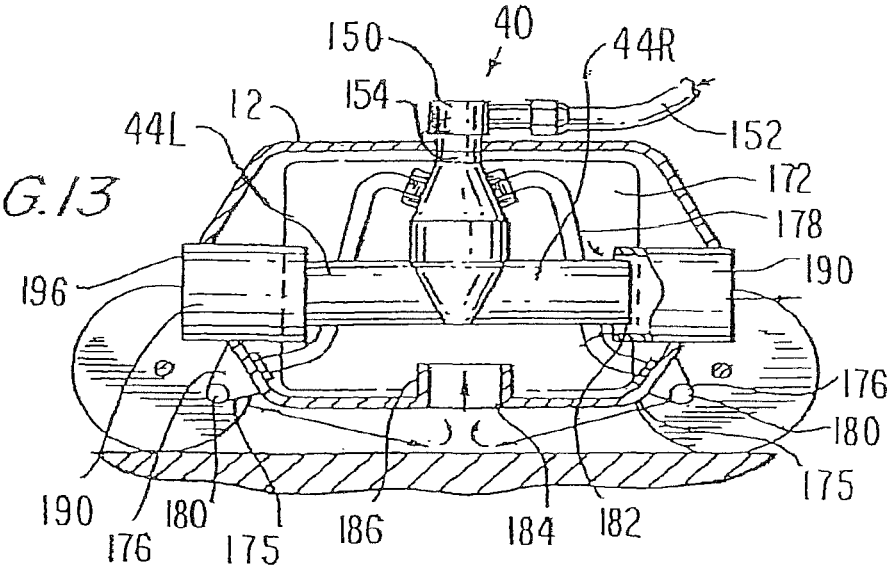
FIG. 13 is a side elevation, partly in cross-section, of a pool cleaner equipped with the water jet valve assembly of the invention and external pressurized water source with venturi discharge openings.

FIG. 13 illustrates a robot of construction similar to that of the cleaner of FIG. 12, where an external pump is used to provide a pressurized stream of water to the cleaner via the discharge outlet 154 of the housing adapter 150. Further, the jet valve assembly 40 with its flap assembly 46 (see FIGS. 1A and 1B) can be used to control the direction in which the pressurized stream of water flows through the conduit $\mathbf{44}_L$ or $\mathbf{44}_R$ to propel the cleaner. This embodiment is further equipped with a coarse filter medium 172 (shown in phantom) and means 176 to dislodge debris from the pool surface so that it can be drawn into the filter 172. The open ends of the discharge conduits 44 (i.e., individually shown as discharge conduits $\mathbf{44}_L$ and $\mathbf{44}_R$) are each fitted with a first end of an expansion sleeve 190 that has an inside dimension (e.g., inner diameter) that is larger than the outside dimension(s) (e.g., outer diameter) of the discharge conduit 44. The opposing end of each expansion sleeve 190 forms a discharge opening 196 from which the discharged water jet is expelled to propel the cleaner. The gap 182 formed between the conduit 44 and sleeve 190 creates a path through which water is drawn by the venturi effect, which is created as a result of the sudden increase in volume of the flow path and corresponding pressure drop. This pressure drop creates a negative pressure inside the robot housing 12 so that the jet streams that converge under the surface 184 of the cleaner are able to lift debris and carry it through the intake port 186 and into contact with the robot's filter medium 172. The jet streams are tapped off the inlet side of valve assembly 40 by hoses 178 connected to a transverse manifold 180 at the front and back of the robot. The manifold 180 has multiple openings 175 that extend across the full width of the robot's housing so that the jet cleaning streams impinge on the entire surface to be cleaned.

Figure 14:
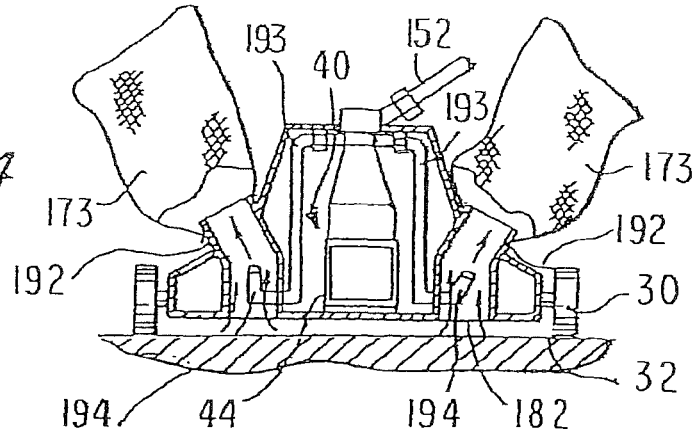
FIG. 14 schematically illustrated an embodiment similar to that of FIG. 13 in which the filter system is externally mounted.

FIG. 14 illustrates another embodiment of the invention in which the cleaning robot is operated by an external pump (not shown). As shown in the cross-sectional view, the cleaner is provided with two external coarse filter or collector bags 173 that are secured to the outlets of the venturi chambers 192. Outlet jets 194, fed by hoses 193, are positioned in the chambers 192. Water issuing from jets 194 creates a low pressure zone drawing up water and loose debris from beneath cleaner 10, the debris being retained by filter bag 173. The chambers are connected to the intake side of the jet valve housing 44.

Figure 15:
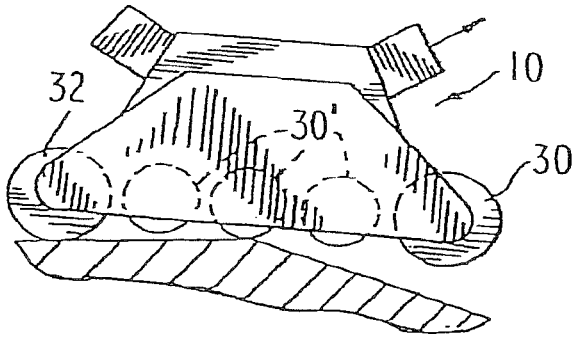
FIGS. 15-17 are side elevation views of a cleaner provided with auxiliary support means in accordance with the invention to improve the movement over obstacles and irregular surfaces.

FIG. 15 illustrates a robot that is equipped with a plurality of auxiliary wheel or rollers 30' along the bottom or sidewalls between the supporting wheels 30 at either end of the cleaner 10. The auxiliary wheels can be mounted for free rotation on the housing 12 or external side plate. This configuration prevents the robot from being immobilized on a hump or other vertical discontinuity in the bottom surface of the swimming pool or tank being cleaned.

Figure 16:
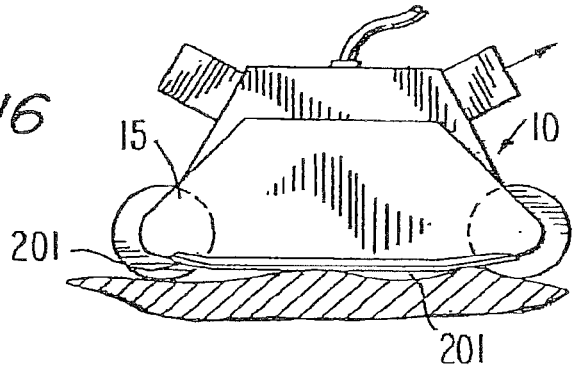

FIG. 16 illustrates a robot similar to that of FIG. 15, but instead of wheels or rollers, the bottom edges of the robot's side walls 12 or side plates 15 facing the pool surface are provided with Teflon* or other low-friction engineering plastic strips 201 so that the apparatus slides along on the bottom edges.

Figure 17:
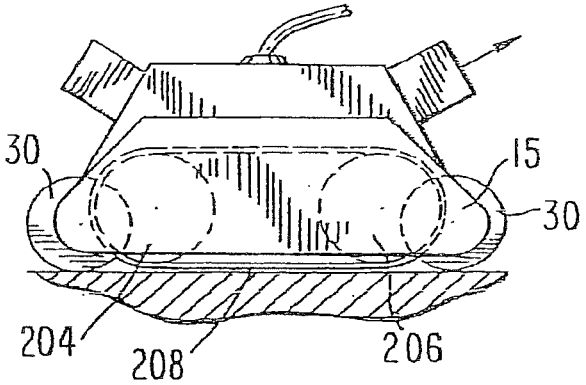

FIG. 17 illustrates another embodiment of the robot that is equipped with "immobilization" means. These means comprise two idling wheels 204, 206 connected to each other by a belt 208. It should be noted that although the so-called "immobilization" devices generally are installed on opposing sidewalls of the robot, there are instances in which it is desirable to equip the robot only on one side. This will result in random turning of the robot in one direction or the other whenever it goes over a hump as shown in FIG. 15.

Figure 18:
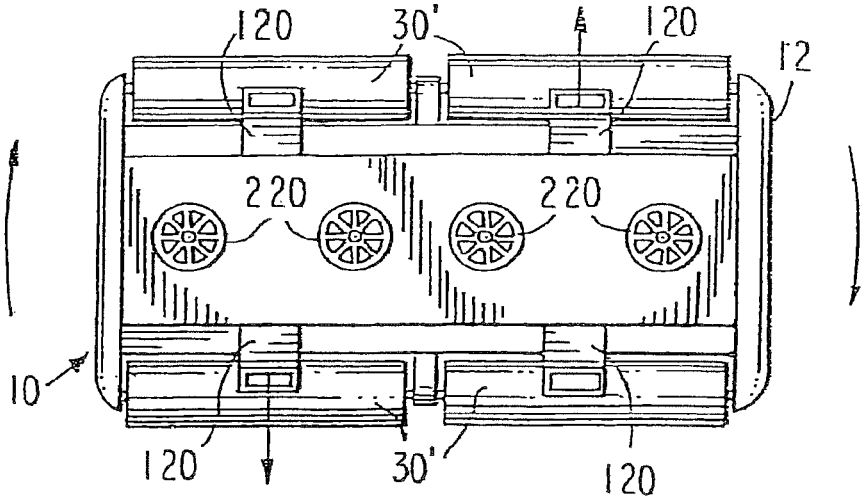
FIG. 18 is a top plan view of a tandem cleaner provided with two water jet valve assemblies of the invention.

FIG. 18 illustrates a cleaning robot with two water jet valve assemblies to which are attached directional flow elbows 120. In addition, there are a plurality of pumps having outlets 220 to increase the vacuum effect and cleaning ability of the robot. The multiple jet valve system is especially suited for remote control operation, since each jet valve can be controlled independently. As illustrated, the robot is equipped with rollers 30; however, wheels can also be used with this embodiment.

Vertical Pivot Axis

Figure 19:
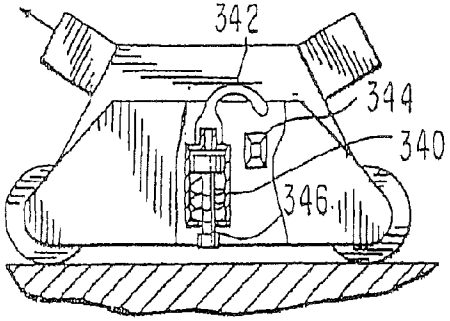
FIG. 19 PRIOR ART
FIG. 19 is a side elevation of a prior art pool cleaner, partly cut away to show a fluid activated plunger assembly.

FIG. 19 illustrates a conventional fixed spring-loaded cylinder assembly 330 of the prior art which is activated by hydraulic force supplied by a pump motor (not shown) via hose 342, the timing of which is controlled electronically, e.g., by a pre-programmed integrated circuit device 344. When the hydraulic force is applied, the piston 346 moves to engage the surface causing the cleaner to pivot about the axis of piston 346. Use of this device produces random motion by the cleaner.

Figure 20:
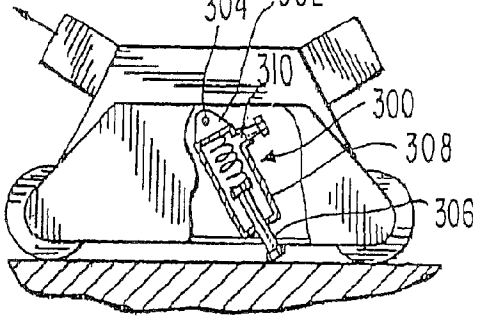

FIG. 20 illustrates a robot that is equipped on one side only with a cylinder assembly 300 that is free to rotate longitudinally towards both ends of the cleaner. The assembly's upper end 302 is pivotally mounted at 304 on the side of the robot at a position that is transversely displaced from the central longitudinal axis of the apparatus. At the lower end of the cylinder 300, a spring-loaded piston 306 extends downwardly toward the bottom of the pool. Each time the robot reverses its direction, the cylinder assembly 300 applies a transitory frictional braking force to the motion of the robot on one side which results in a pivoting action about the vertical axis of the piston and the repositioning of the longitudinal axis of the apparatus. This braking action lasts until the piston 306 is pushed into the surrounding cylinder 308 far enough to allow the cylinder assembly to pivot past its vertical position. The rate at which the piston moves can be controlled, e.g., by an adjustable valve 310 at the top of the cylinder. In the practice of this embodiment of the invention, the robot can have wheels mounted on fixed axles in parallel relation and still be able to scan the bottom surface of a rectangular pool.

Figure 21:
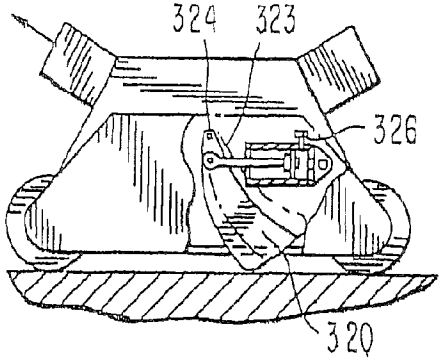
FIGS. 20-22 are side elevation views of pool cleaners, partly cut away, to show laterally mounted directional pivot assemblies of the invention.

FIG. 21 illustrates a robot that is equipped with an arm 320 pivotally mounted on one side of the cleaner housing at a position similar to that of FIG. 20, but which engages the pool bottom when the cleaner moves in only one direction. The lower end of arm 320 is arcuate, e.g., shaped as a segment of a circle, the center of which coincides with the pivot point 324 of the arm. A cylinder assembly 322 similar to the one described in FIG. 20, but without the spring, is pivotally linked to the arm at 323. However, the piston 326 is free to move in one direction only; movement in the other direction is controlled by an adjustable valve 310. When the robot changes direction, only every second time does the cylinder assembly apply a frictional braking force to halt the forward motion of the robot. Use of this apparatus and method of operation produces a scanning pattern for the cleaner that which consists of alternating perpendicular and angular paths with respect to the sides of a rectangular pool. In pools where the robot climbs the vertical side walls, the braking or pivot arm will continue to pivot while on the wall (due to gravity) as shown in phantom, so that when the robot comes off the wall, the arm will not immediately touch the bottom of the pool. In this mode of operation, a few seconds will pass before gravity pulls the arm 320 down to make contact with the bottom surface of the pool. The robot will move horizontally for a short distance before it changes direction by pivoting around the pivot arm.

Figure 22:
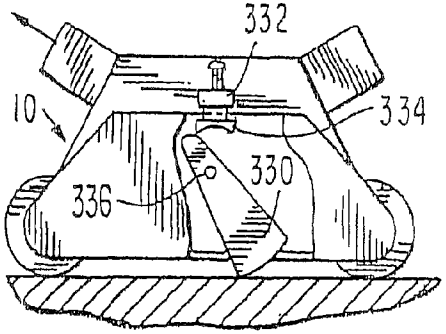

FIG. 22 illustrates yet another embodiment in which pivot arm 330 extends in a downward direction to make contact with the bottom floor of the pool to provide a frictional braking force in both directions of movement and a pivot axis on one side of the robot 10. This mechanism works similarly to that of FIG. 20, and is relatively simpler and less expensive. A friction pad 334 is attached to adjustment means 332 which permits the frictional contact between the pad 334 and end of pivot arm 330 to be varied to thereby control the pivoting time that the opposite end of said arm is in contact with the pool surface and before disengagement of the pad and pivot arm. The friction pad can be a directional resistance material that is, greater resistance is provided in one direction than in the other.

Figure 24:
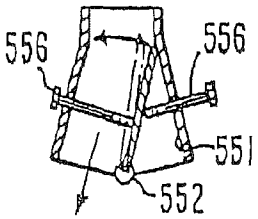
FIG. 24 is a top cross-sectional plan view of the diverter mechanism of FIG. 23.
Figure 23:
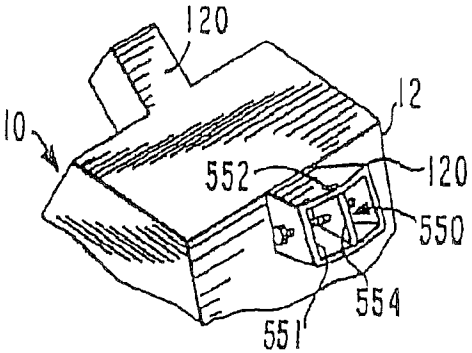
FIG. 23 is a top and side perspective view of a portion of a pool cleaner to show a discharge conduit provided with an adjustable diverter for varying the directional discharge of the water jet form the valve assembly.

As shown in FIG. 23, the open end of one or both of the outlets of the discharge conduit or directional flow elbow is provided with internal flow diverter means 550. Internal dove tail configuration 35 has an outwardly tapered throat and is provided with adjustable diverter flap 554 in the discharge flow path that directs the flow of water to one side or the other of the outlet 120. As more clearly shown in the cross-section view of FIG. 24, the dove tail outlet is provided with diverter flap positioning means 556, e.g., two set screws to adjust the position of the diverter flap 554. The cross-sectional area of the elbow when the diverter means is positioned at one side or the other is about the same as the area of the discharge conduit 120, i.e.; there is no restriction of the flow, or increased back pressure. By having the water jet exit angularly to the left or to the right of the longitudinal centerline, the robot will follow an arcuate path in one direction or the other. The radius of the arc can be controlled by the adjustable positioning of the diverter flap 554. The cleaning apparatus of this embodiment can also be set to operate in a more random manner by retracting the adjusting screws 556 to allow the diverter flap to pivot freely from left or right each time the water jet impacts it. A manually adjustable flap 554 enables the user to change its position from time to time in order to unwind a twisted power cord, should that occur.

Figure 25:
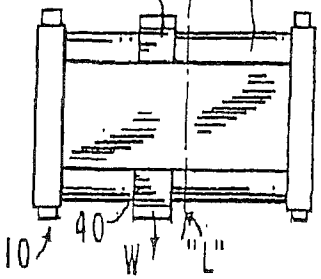
FIG. 25 is a top plan view of a cleaner illustrating one embodiment of offsetting the discharge conduits to produce a non-linear movement of the cleaner in both directions.

FIG. 25 illustrates another method by which a scanning pattern is achieved without changing the position of the wheels or the axles. The jet valve assembly 40 is positioned off-center of the central longitudinal axis "L" of the cleaner 10 to thereby produce movement in a semi-circulator other curvilinear pattern.

Figure 26:
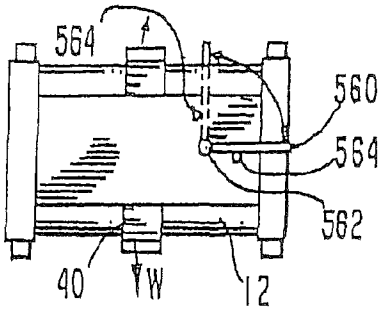
FIG. 26 is a top plan view of a cleaner provided with means to create an uneven hydrodynamic drag force on side of the cleaner to produce a non-linear movement of the cleaner in one direction.

FIG. 26 illustrates another embodiment in which a scanning movement is achieved by providing the exterior of the housing 12 with a configuration that presents an asymmetrical hydrodynamic resistance to movement through the water. In the specific embodiment illustrated, the unequal hydrodynamic resistance is effected by adding a resistance flap 360 to one side of an otherwise symmetrically designed robot housing 12. The water resistance causes the robot to curve to the left or right. If the resistance means is pivotally mounted at 362 as shown, the robot moves straight in one direction and assumes a curved path in the other. A plurality of flap position members 364 are provided for adjusting the stop position of pivoting flap 360 to thereby vary the resistance. The asymmetrical hydrodynamic resistance can also be achieved by integrally molding the housing on one or both ends so that it presents unequal hydrodynamic resistance during movement.

Power Cord Swivel Connector

In order to reduce or eliminate interference with the scanning pattern of the cleaner associated with twisting and coiling of the floating power cord 70 as the cleaner repeatedly changes direction which results in the tethering of the cleaner, another embodiment of the invention comprehends a swivel or rotatable connection at a position along the power cord, or between the power cord and the moving cleaner.

Figure 27:
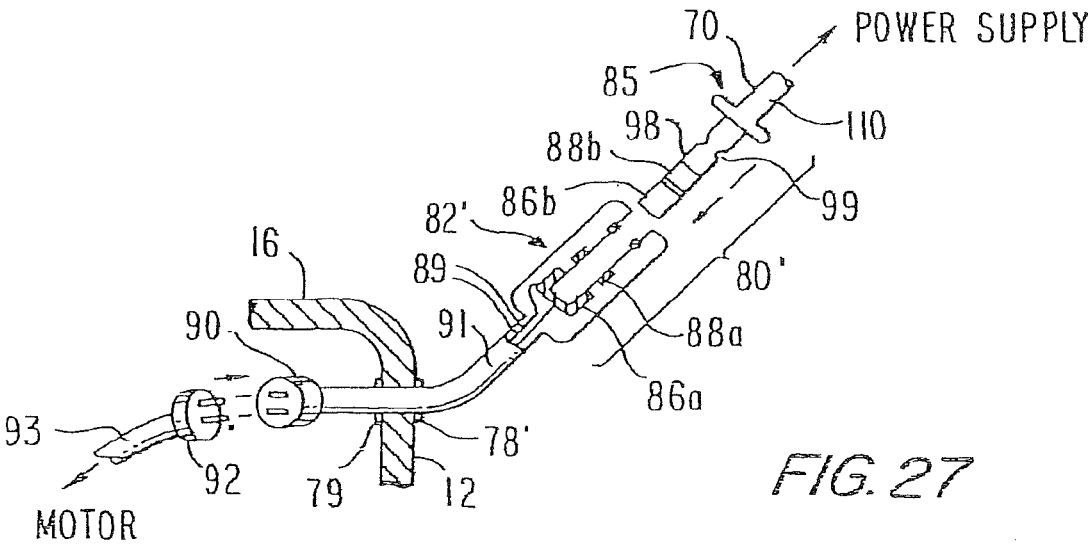
FIG. 27 is a side perspective view, partly in cross-section of an in-line electrical connector of the invention shown in relation to a segment of the cleaner housing.

With reference to FIG. 27, there is schematically illustrated a cross-sectional view of the upper surface 16 of housing 12 provided with an aperture 78 adapted to accommodate socket portion 82 of electrical swivel connector socket 80. Socket 82 is fabricated from dielectric material 83 and is provided with electrical contacts 86*a* and 88*a* which in turn are joined to female plug 90 by conductive wires 89. Plug 90 is adapted to mate with male plug 92 which terminates electrical wire 93 from the motor (not shown.)

With further reference to socket 82, a groove 94 is provided proximate the open end to receive an o-ring 96 or other means for sealing the socket and locking the plug or jack portion 84 into secure mating relation. Jack 84 is comprised of insert member 98 fabricated from dielectric material, and electrical contacts 86*b* and 88*b* that are adapted to be received in sliding contact with corresponding elements 86*a* and 88*a* in socket 82. Insert member 98 is also provided with a groove or annular recess 99 that is adapted to engage ring 96 in fluid-tight sealing and locking relationship when jack 84 engages socket 82. It will also be understood that different or additional means can be provided to secure the mating sections 82 and 84 together that will also permit them to rotate when mated. Insert member 98 is secured in water-tight relation to right angle member 100, preferably fabricated from a resilient dielectrical material, through which are passed a pair of electrically conductive wires (not shown) from power cord 70 that terminate, respectively, at conductors 86*b* and 86*b*. Right-angle jack member 100 is also constructed with a plurality of flexure members 102 about its periphery in order to provide additional flexibility between the housing connection and the power cord 70 during operation of the cleaner. It will be understood that the right-angle jack member 100 will freely swivel in the opening of socket member 82 in response to a force applied by power cord 70. Thus, the power cord 70 remains free of coils, does not suffer any effective shortening in its length and therefore does not exert any tethering restraining forces on the cleaner that would adversely effect the ability of the cleaning apparatus to freely traverse its path.

Figure 28:
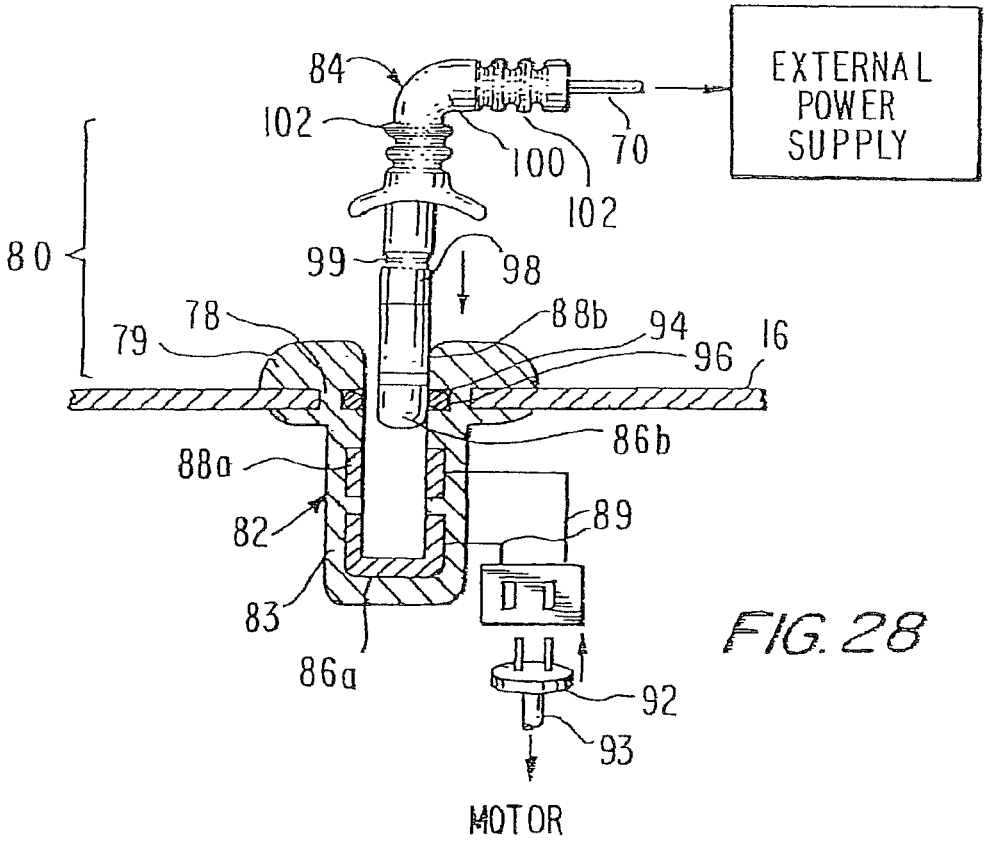
FIG. 28 is a side elevation view, partly in cross-section, of an angular electrical swivel connector of the invention.

With reference to FIG. 28 there is shown a second embodiment of an electrical swivel connector for joining the power cord 70 to the motor electrical wire 93 via elements as described above in connection with FIG. 27. In the embodiment illustrated, a straight-line swivel is comprised of socket member 82' and plug member 85, the former being joined by a short length of power cord 91 extending through restraining gasket 79 secured in opening 78' in a sidewall of cleaner housing 12. The two sections of the swivel connector are securely joined together in rotating relationship as described above with reference to FIG. 27. As the cleaning apparatus moves about the pool surfaces, the socket 80 moves in response to the tension transmitted through power cord 70 and any twisting or torsional forces are dissipated by the rotation of plug 85 in socket member 82. The power cord therefore does not form coils, or otherwise have its effective length reduced, and does not stop adversely effect the movement of the cleaned.

Figure 29:
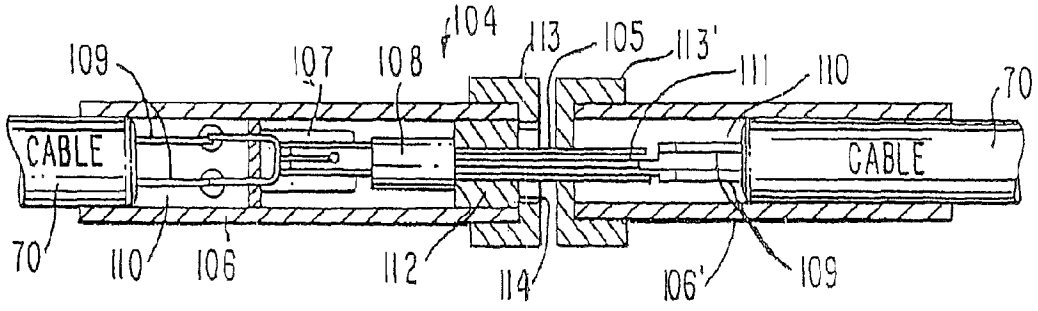
FIG. 29 is a plan view, partly in cross-section, of another embodiment of an in-line swivel electrical connector.

In another preferred embodiment of the swivel connector, a permanent in line or straight connection between two sections of power cable 70 is provided by a connector permitting angular displacement between-its elements. As illustrated in FIG. 29, connector 104 comprises a rigid non-corroding ferrule 105, which can be in the form of a length of polymeric or stainless steel tubing that extends between waterproof tubular junction members 106, 106' that also receive opposing cable ends 70. One of the junction members 106 contains electrical connector jack 107 and plug 108 which are axially rotatable with respect to each other. A conductor pair 109 of cable 70 are permanently joined to the adjacent terminals of jack 107 and secured in place within junction member 106, e.g., by a plug of flowable epoxy resin 110 or other potting material that hardens after the elements have been assembled.

With further reference to FIG. 29, a pair of conductors 111 extending from the rear of plug 108 extend axially through ferrule 105 and a bushing 112 is placed on ferrule 105 to engage the rear shoulder of jack 108. In a preferred embodiment, the ferrule end is flared and the adjacent surface of annular bushing 112 is shaped to receive the ferrule. The junction member containing the connector jack and plug is completed by securing on tubular member 106, cap 113 having a central orifice into which is secured axial seal 114 which passes over ferrule 105 and permits rotation of the ferrule in water-tight relation. The assembly of the adjoining junction member 106' is completed by joining conductor pair 111 to the conductor pair 109 of cable 70 and filling the end with flowable epoxy resin 110 and installing cap 113'. When the epoxy or other potting compound has set, it will be understood that the two ends of cable 70 are permanently joined and that ferrule 105 has been secured to junction member 106' in water-tight relation and that plug 108 is free to rotate with respect to jack 107 and the assembly of junction member 106. In this embodiment, the swiveling or rotatable connector assembly 104 is positioned approximately three meters from the cleaner to reduce the likelihood that the user will lift the cleaner from the pool using a section of the power cable that includes the connector.

Figure 30:
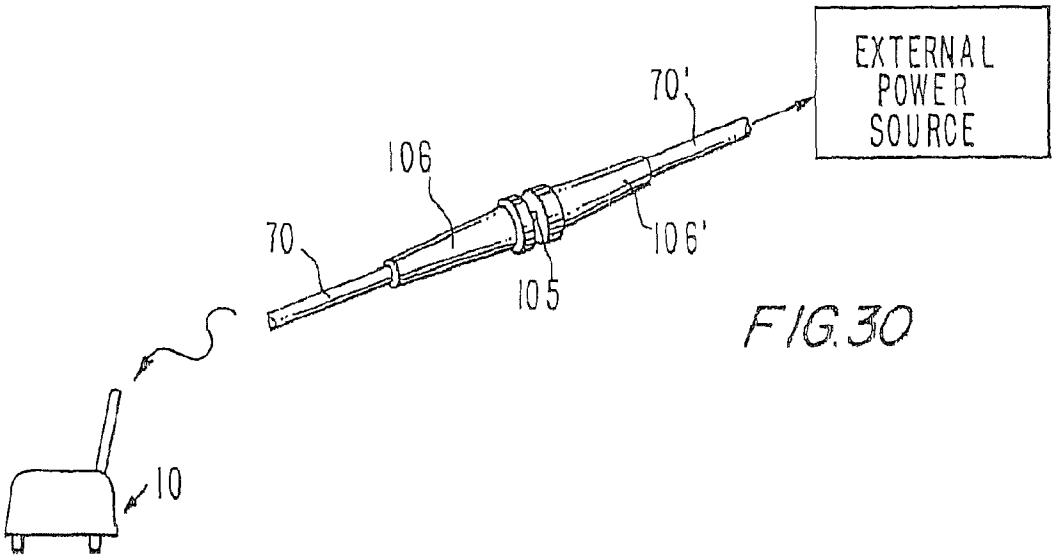
FIG. 30 is a prospective view of the assembled in-line swivel connector of FIG. 29 schematically illustrating its relation to the cleaner.

As schematically illustrated in FIG. 30, any twisting or torsional forces transmitted by the movement of the cleaner 10 through the attached length of power cord 70 will be dissipated by the rotation of member 106.

It will also be understood by one of ordinary skill in the art that various other mechanical constructions can be provided that will permit relative rotation between adjacent sections of the power cable, one end of which is attached to the cleaner and the other to the external fixed power supply to thereby eliminate the known problems of cable twisting, coiling and tethering that adversely effect the desired scanning patterns or random motion of the pool cleaner.

Axle Orientation

Figure 31A:
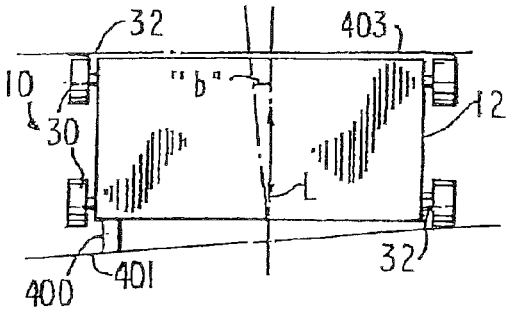
FIG. 31A PRIOR ART
FIGS. 31A and 32A are top plan views schematically illustrating the prior art construction of a pool cleaner with pivot members extending from the front, and from the front and rear, respectively, in the direction of movement of the cleaner.
Figure 32A:
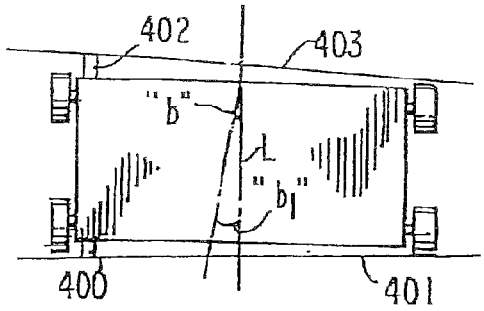
FIG. 32A PRIOR ART

By way of background, the series of FIGS. 31A and 32A are representative of the prior art. FIGS. 33-44 schematically illustrate in plan view the apparatus and methods embodying the invention to control the movement of a swimming pool cleaning robots 10 to produce systematic scanning patterns and scalloped or curvilinear patterns, and to provide controlled random movement on the bottom surface of pool. The configurations will provide one or more of the above three mentioned movements. The cleaner can be propelled either mechanically or by a discharged jet or stream of water.

In the prior art arrangement shown in FIG. 31A, an offset extension member 400 is secured to one end of housing 12 at a position that is displaced laterally from the longitudinal axis "L" of the cleaner and which causes the robot to position itself angularly in relation to vertical swimming pool wall 401 (shown in phantom.) When the robot 10 reverses its direction, it travels at an angle "b" away from the side wall 401. When cleaner 10 contacts the opposite side wall 403, the robot's body again pivots and comes to rest in a position where its longitudinal axis "L" is at a 90 degree angle to side wall 403. The resulting scanning pattern is illustrated in FIG. 31B.

Figure 32B:
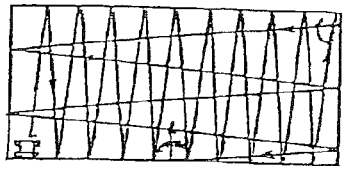
FIG. 32B PRIOR ART

In the prior art configuration of FIG. 32A, a second offset extension member 402 is added to the housing opposite extension member 400. The scanning pattern provided by two opposing extension members is generally shown in FIG. 32B. The 90 degree pivoting turns occur in both a clockwise and counter-clockwise direction.

In accordance with the improved method and apparatus of the invention, separate members projecting from the front and rear housing surfaces are eliminated, and in one preferred embodiment, at least one supporting wheel, or track, or roller end, projects beyond the periphery of the cleaner in the direction of movement to contact a vertical side wall or other pool surface.

Figure 31B:
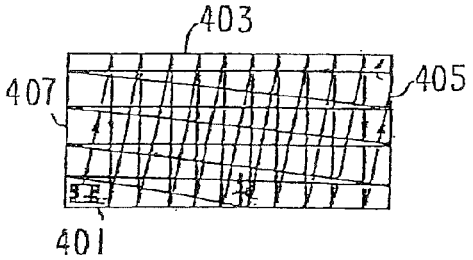
FIG. 31B PRIOR ART
FIGS. 31B and 32B are schematic representations of the pattern of movement of the prior art pool cleaners of FIGS. 31A and 32A, respectively.
Figure 33:
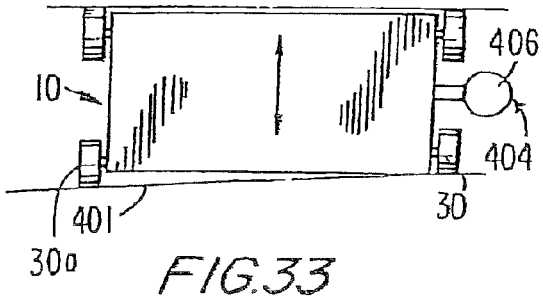
FIGS. 33 and 34 are top plan views schematically illustrating embodiments of the invention in which the cleaner's supporting wheels extend beyond the periphery to the front and to the front and rear, respectively to provide a pivot point.

In the preferred embodiment of FIG. 33, one of the wheels 30*a* is mounted so that it projects forward of the housing 12 as a pivot point and thereby causes the same angular alignment between the robot 10 and swimming pool wall 401, as the apparatus of FIG. 31, and produces a scanning similar to that of FIG. 31A. With further reference to FIG. 33 is a ball-shaped side extension 404 terminating in tip 406 formed of resilient, soft rubbery material which, when it comes in contact with the end wall of pool 405, 407, causes the robot to make a 90 degree pivoting turn, indicated turn by arrow in FIG. 31B. As the pattern shows, every time this 90 degree turn occurs the cleaner turns in a clockwise direction. It will be understood that if the side projection member 406 had been placed at the upper left side of the housing 12, the 90 degree turns would have been counter-clockwise.

Figure 34:
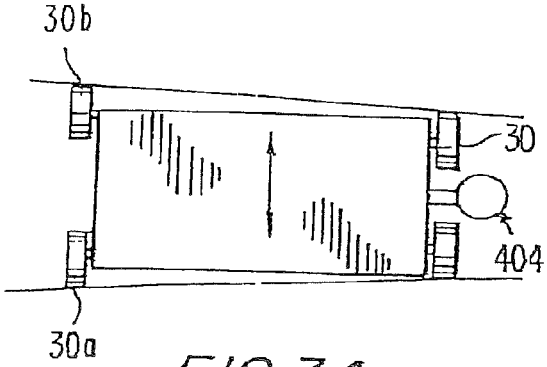

In the embodiment of FIG. 34 two opposing wheels 30*a*, 30*b* at the left side of robot 10 are mounted forward of the periphery at their respective ends of the cleaner to provide a translational pivot axis. This configuration creates a scanning pattern similar to that shown in FIG. 32B. In this embodiments of FIGS. 31A to 34, the wheels are individually rotatable and their axles are stationary. With this embodiment, power cable twisting is not a problem.

Figure 35:
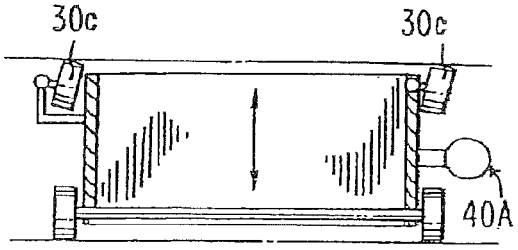
FIGS. 35-44 are top plan views schematically illustrating embodiments of the invention in which the cleaner's supporting wheels are mounted on one or more axles that are offset at an angle to line that is normal to the longitudinal axis of the cleaner.

With reference to the embodiment of FIG. 35, a pair of wheels 30*c* is mounted on caster axles pivoted for limited pivoting movement defining an arc in the translational plane passing through the center of the wheels. The axles and wheels 30*c* swivel so that when the robot moves in the direction opposite the caster mounts, all four wheels are parallel with each other along the longitudinal axis of the robot. When the robot moves in the opposite direction, i.e., the caster wheels lead, the caster wheel axles swivel or pivot to a predetermined angle, which angle can be adjustable. The robot scans a rectangular pool in a manner shown in FIG. 35A, where the path is curvilinear in one direction and straight in the other. The angular arc can be up to about 15 degrees from the normal, and are preferably adjustable to account for the pool dimensions.

Figure 35A:
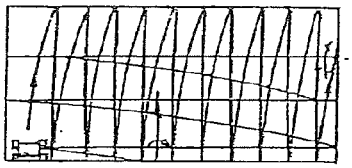
FIGS. 35A and 35B are schematic illustrations of the patterns created by the embodiments of FIGS. 35 and 36.
Figure 35B:
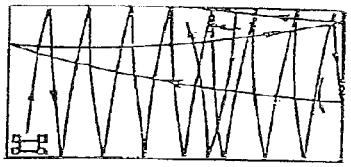

In an embodiment related to that of FIG. 35 (but not shown), all four wheels are caster mounted, the opposing pairs being set for angular displacement when the cleaner moves in opposite directions. That is, depending on the direction of the robot's movement, when one pair of wheels are at an angle to the robot's longitudinal axis the opposite set of wheels are parallel to the axis "L", and vice versa. The scanning pattern would be as illustrated in FIG. 35B.

Figure 36:
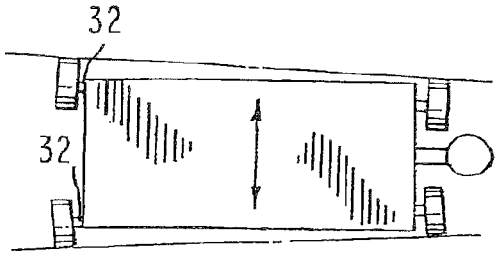

In the embodiment of FIG. 36, the transverse axles 32 are mounted in an angular relation to each other so that the wheels on one side of the cleaner are closer together than those on the opposite side. The scanning pattern is as illustrated in FIG. 5B.

Figure 37:
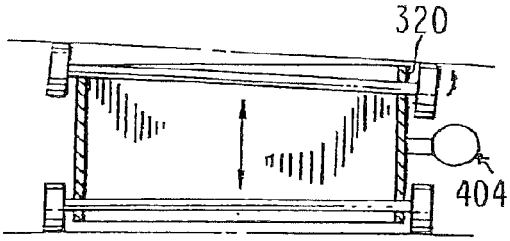

As shown in FIG. 37, one end of one of the axles is mounted in a slot so when the robot moves one direction it follows a curved path, and when it moves in the opposite direction (i.e.; where the slot is in the rear of the cleaner) the robot follows a straight line. (The pattern is shown in FIG. 35A).

Figure 38:
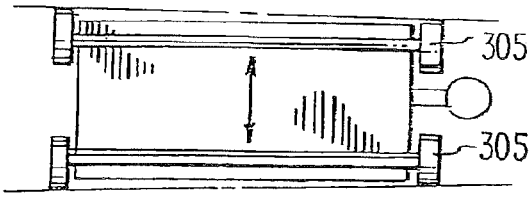

In the embodiment of FIG. 38, the wheel axles are parallel to each other and normal to the longitudinal axis "L" of the robot, and the wheels 305 on one side of the cleaner are smaller in diameter than the wheels on the opposite side. The scanning pattern is as illustrated by FIG. 35B.

Figure 39:
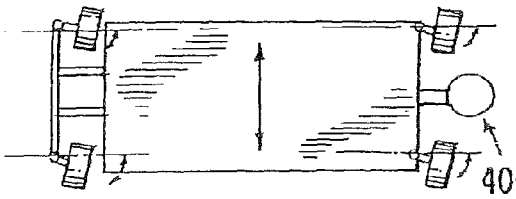

As shown in FIG. 39, all four wheels of the robot 10 are caster mounted, and all four wheels move together to be either parallel to the robot's axis, or at an angle to the axis "L", depending on the direction in which the robot moves. The scanning pattern is as shown in FIG. 31B. The angular displacement can be up to 45 degrees, since all four wheels are moving in parallel alignment.

Figure 40:
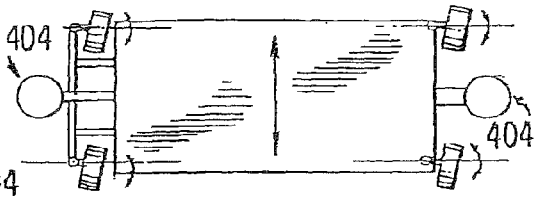

In FIG. 40, the four wheels are mounted to swivel in unison, and move as in FIG. 39. When the wheels are rotated to their extreme (i.e., maximum) positions, they are angular to the robot's body, but symmetrical to each other. This arrangement provides a scanning pattern as shown in FIG. 32B. Again, the angular displacement of the caster wheels can be up to 45 degrees in both directions from the normal. It will be understood that the longitudinal axis of cleaner 10 will be perpendicular to the wall it contacts.

As also illustrated in FIG. 40, both longitudinal sides of the cleaner 10 are provided with at least one projecting member 404. As will be described in more detail below, the pivoting function of side-extending pivot contacts as represented by the specific embodiments of elements 404, can also be effectuated by elements projecting from the external hubs of two or more of wheels 30 (see e.g., FIG. 43), or the side wall surfaces of cover 12 (see, e.g., FIG. 18) or other side peripheral structure of the cleaner 10. The transverse projection of such elements is determined with reference to their longitudinal position and the shape or footprint of the peripheral projection of the cleaner on the pool surface. For example, a side-projecting frictional pivot member located at the leading edge of a generally rectilinear cleaner will require less projection than a single member of FIG. 33 that is located mid-way between the ends of the cleaner.

Figure 41:
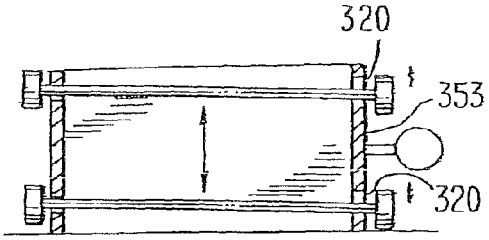

In FIG. 41, both axles are mounted in slots 320 on one side of the unit so that the wheels adjacent the slots can slide up and down to be either parallel to the robot's longitudinal axis, or at an angle thereto, depending on the direction of movement of the cleaner. This arrangement produces the scanning pattern of FIG. 31B.

Figure 42:
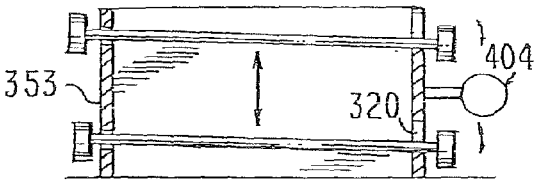

In the embodiment of FIG. 42, the axles swivel in larger slots 320 to achieve angular positioning of wheels to the robot's body in both extreme positions, but in symmetrical fashion, with a resulting scanning pattern as shown in FIG. 32B.

From the above description, it will be understood that when operating in a rectangular pool or tank, the embodiments shown in FIGS. 39-42 allow the robot to move parallel to the swimming pool's end walls, even when it travels other than perpendicular to the sidewalls. In other words, the correct scanning pattern does not require an angular change in the alignment of the robot's body caused by a forceful contact with a swimming pool wall as with the prior art. This is particularly important where a water jet propulsion means is employed, because as the filter bag accumulates debris in the jet propulsion system, the force of the water jet weakens and the force of impact lessens, so that the robot's body may not may not be able to complete the pivoting action required to put it into the correct position before it reverses direction. This is especially true in Gunite or other rough-surfaced pools in which a robot with even a clean filter bag may not be able to pivot into proper position because the resistance or frictional forces between the wheels and the bottom surface of pool may be too great to allow the necessary side-ways sliding of the wheels before reversal of the propelling means occurs.

Figure 43:
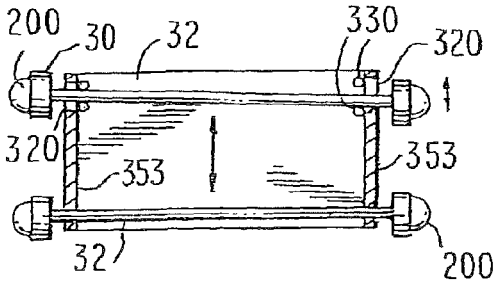

As shown in FIG. 43, one of the axles is mounted in slots 320 that permit it to move longitudinally at both ends. This longitudinal sliding motion is restricted by one or more repositionable guide pins 330. These pins allow the user to adjust the angular positioning of the axle to accommodate the width or other characteristics of the pool. By reversing the position of the pins on both left and right sides, the robot will follow a pattern which is similar to that shown in FIG. 35A. This method of operation will also unwind a twisted cable.

With further reference to FIG. 43, there are shown mounted on the ends of axles 32 or hubs of wheels 30 side projecting pivot member 200. These members serve the same function and can be constructed of materials as described with reference to side projecting members 404 as described in connection with FIG. 33, above. Pivot member 200 can be mounted on one or both sides of the cleaner 10 to engage the sidewall of the pool and cause the cleaner to pivot into that wall.

Figure 44:
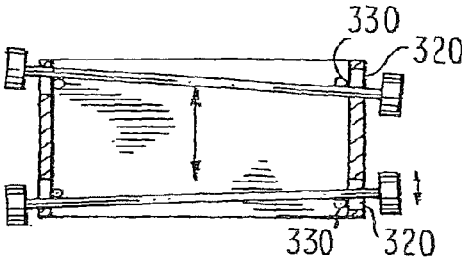

In FIG. 44, both axles are mounted in slots permitting longitudinal movement at both ends. This will allow the robot with proper positioning of the guide pins to advance in a relatively small circular pattern in one direction and in a slightly larger one in the other.

It is to be noted that the odd-numbered embodiments of FIGS. 31 to 44 illustrate devices which turn only one way when they make 90 degree pivoting turns, and that the embodiments of even-numbered FIGS. 2 to 14 turn both ways. Simply put, when the robot scans in an asymmetrical pattern, such as in FIGS. 1A, 3, 5, 7, 9, 11 and 13, it turns either clockwise or counter-clockwise; when the robot scans in a symmetrical pattern, such as in FIGS. 2, 4, 6, 8, 10, 12 and 14, it turns in both directions. The two main categories are in relation to their movements. Within these principal categories, there are variations where straight-line movements are replaced by curved paths, e.g., in FIG. 20, or the two are combined, e.g. in FIG. 18.

It is relatively easy to clean a rectangular pool in any systematic scanning manner as shown above, but it is more difficult to clean an irregularly-shaped pool. Applying the method and apparatus of the invention and using the guide pins set as described above, the robot can scallop a free form pool in a systematic manner as shown in FIG. 46.

FIG. 45 shows the six different arrangements in which each wheel 32 can be positioned. By pressing the appropriate pins 330 down or pulling them up, the wheel axle 30 can be placed in three stationary positions: outside, center and inside. It can also be placed in three sliding positions outside to inside; outside to center; and center to inside. Since there are four wheels, the total combination of positions of these wheels is 1296 (6 to the 4th power) which provides a total of 361 different scanning patterns.

In a particularly preferred embodiment employing a transverse axle 32 one-half inch in diameter, the axle supporting members 353 are provided with slots 320 extending 1.5 inches longitudinally to receive the axle in slidable relation. Each slot is provided with a central lock pin 330 which can optionally be withdrawn from the slot. This configuration provides a sufficiently large number of combinations and angular displacements of wheels and axles to cover essentially all of the sizes and shapes of pools in common use today. The flexibility of this embodiment gives the user the ability to select an optimum cleaning pattern for all types, sizes and shapes of pools.

The embodiment illustrated in FIG. 47 provides an apparatus and method that automatically switches the positions of two wheels when the scanning robot reaches the end of the pool. Unlike the embodiments described above that provided the robot with means by which to turn 90 degrees clockwise or counter-clockwise, this embodiment allows the robot to maintain its orientation in a rectangular pool that is parallel with the swimming pool's walls. Using this embodiment, the power cord cannot become twisted or formed into tight coils. Moreover, a coarse surface having a high coefficient of friction does not adversely effect desired scanning patterns. The robot has two side plates 350 which are provided with horizontal slots 352 to hold the ends of transverse axle 32. Pivotally mounted at pivot pin 353 on the inner side of the side plates and overlapping the horizontal slots are two identical guide plates 354, 354' each of which is provided with an L-shaped slot 355 to freely accommodate movement of axle 32. Two levers 356, each of which is pivotally mounted at one of its ends concentrically with the pivot point of each of the guide plates. The other end of each lever 356 extends into a 45 degree slot 358 provided in slidably mounted in transverse cross-bar 360, which cross-bar extends beyond the periphery of a side wall of housing 12 a distance that is sufficient to contact on adjacent pool wall. Each of said guide plates 354 is linked with its corresponding lever 356 through a spring 362, said spring being secured to pins 364 protruding from said guide plates and levers.

With respect to FIG. 48A, which is a view taken along line 22-22 of FIG. 47, it can be seen that spring 362 is pulling guide plate 354 counter-clockwise holding the longer vertical leg of the upside down L-shaped slot in position for the wheel axle to slide freely.

With reference to FIG. 48B, which is a view taken along line 23-23 of FIG. 47, it can be seen that spring 362 pulls corresponding opposite guide plate 354' clockwise, locking that end of wheel axle 32 into a forward stationary position relative to the opposite end of the axle.

During operation, as the cleaner approaches a pool side wall that is generally parallel to the longitudinal axis of the cleaner, the projecting end 360R of the slidably mounted cross-bar comes in contact with the swimming pool wall, and the bar slides to the left, as indicated FIG. 49. This horizontal movement of bar 360 is translated into a vertical or lifting force on levers 356 via the 45 degree slots 358 in bar 360. This results in the flipping of levers 356 to their opposite side. This movement causes springs 362 to pull their respective guide plates 354, 354' to the opposite position, locking the right end of the axle 32, while freeing up the left end. While this action on the left end of axle 32 is instantaneous, the right end is not locked in position until the robot reverses direction, at which time the right end of axle 32 slides into a trap provided by the short leg of L-shaped slot 355 in guide plate 354. Using this apparatus, the cleaner 10 continues to travel back and forth between the same end walls of the pool but over a different reverse path that is determined by the angular displacement of the wheels and/or axles, thereby assuring cleaning of the entire surface.

FIG. 50 illustrates another embodiment of the invention in which pool cleaner 10 is provided with a plurality of rolling cylindrical members in place of wheels. The long cylinder 500 is driven at one end by a flexible chain belt 510 at presses around sprocket 512 attached to an electric motor or water turbine drive shaft (not shown.) A pair of shorter rollers 502, 504 is mounted on transverse axle 506. As schematically illustrated, the right end of axle 506 is free to move longitudinally in slot 508 provided in axle support member 520. The use of a drive chain and sprocket allows for changing alignment of supporting axle 506 and eliminates problems of tensioning and resistance to movement associated with timing belts used by the prior art. A cleaner constructed in accordance with this embodiment will exhibit a scanning pattern similar to that of FIG. 32B.

FIG. 51 schematically illustrates a robot 10, which uses a pair of drive belts or chains 510*a*, 510*b* to power two cylindrical members 500, 501. The right end of axle 506 is free to move in slot 510 provided in axle support member 520 and the opposite end of axle is provided with a universal joint 522 which in turn is attached to a driven pulley or sprocket 512. The scanning pattern of this unit is also similar to the one shown in FIG. 32B.

With further reference to FIGS. 50 and 51, there are shown side projecting pivot members 202 secured to the exterior of side supporting member 520. Similarly, pivot members 202 can be secured to the opposite side, e.g., on housing 12, or other outboard supporting member to provide a point of frictional engage with a sidewall of the pool to effect a pivoting turn of the cleaner into the wall where it is properly oriented for eventual movement away from the wall, e.g., upon reversing of the cleaner's water jet or other drive means.

It will be understood that in the apparatus of FIGS. 31-44 the wheels mounted on transverse axles can be replaced with cylindrical roller members of the types illustrated in FIGS. 50 and 51.

In determining the optimum angular displacement of the axles and caster mounted wheels, it will be understood that the length of the longitudinal slots provide a practical limitation on the angle of the axle, while the caster axles can provide a greater angular displacement for the wheels. The angular displacement of the coaster wheel axles can be up from 20 degrees to 45 degrees from the normal and are preferably up to 10 degrees, the most preferred being up to about 5 degrees from the zero, or normal line.

Auto-Reversal Sequence

One embodiment of the apparatus and method of the invention addresses problems associated with the immobilization of the cleaner. The electronic control means of the pool cleaner is programmed and provided with electrical circuits to receive a signal from at least one mercury switch of the type which opens and closes a circuit in response to the cleaner's movement from a generally horizontal position to a generally vertical position on the sidewall of the pool or tank. The use of mercury switches and a delay circuit to reverse the direction of the motor is well-known in the art. As will be understood by one of ordinary skill in the art, a pool cleaner can become immobilized by a projecting ladder or other structural feature in the pool so that its continuing progress or scanning to clean the remaining pool surfaces is interrupted. In accordance with the improvement of the invention, the electronic controller circuit for the motor is preprogrammed to reverse the direction of the motor automatically if no signal has been generated by the opening (or closing) of the mercury switch after a prescribed period of time. A suitable period of time for the auto-reversal of the pump or drive motor is about three minutes.

Figure 52:
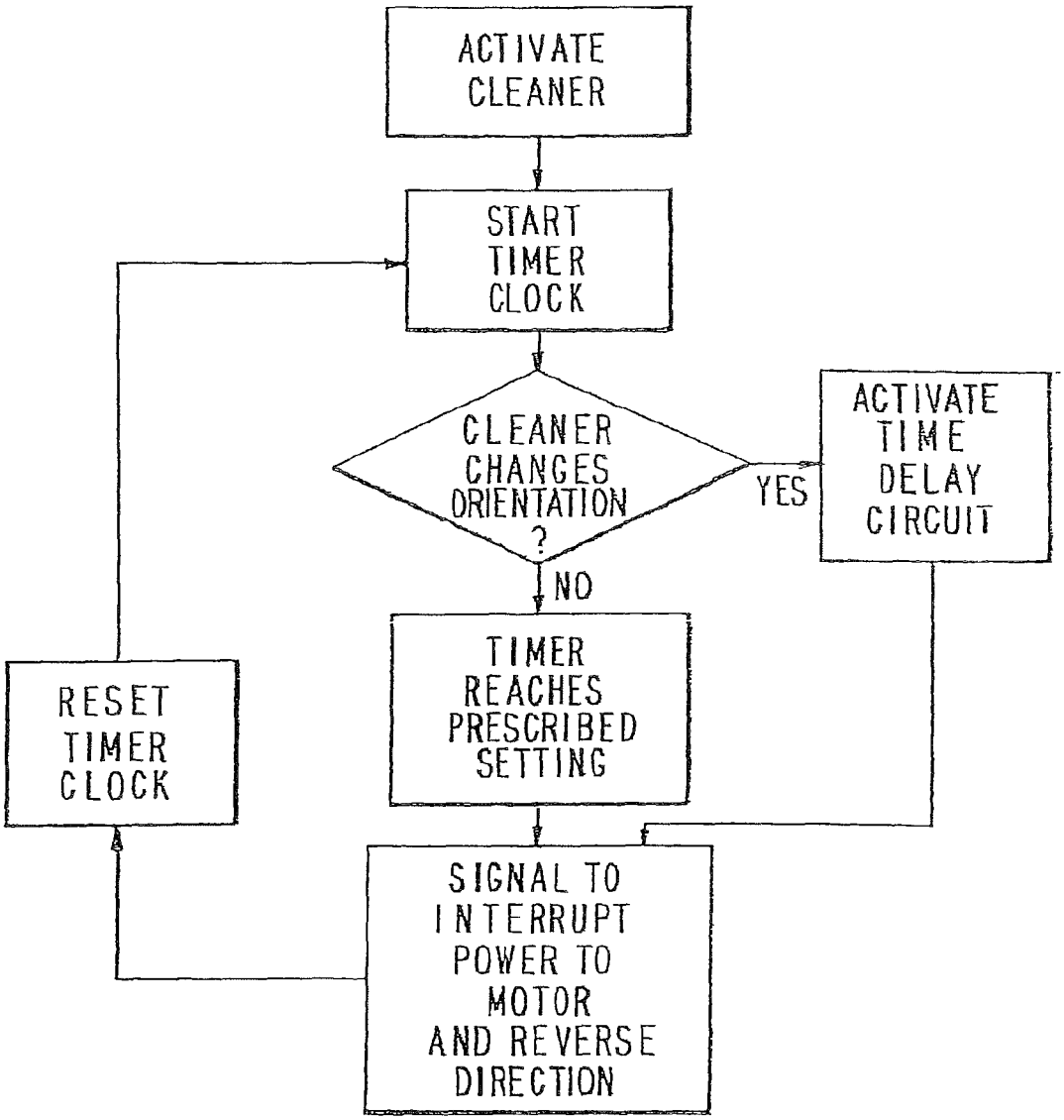
FIG. 52 is a flow chart illustrating a method of the invention for reversing the direction of movement of a cleaner in accordance with a prescribed program.

This sequence of program steps is schematically illustrated in the flow chart of FIG. 52, where the time clock begins to count-down a prescribed time period after the cleaner is activated. In a preferred embodiment, the timer can be manually set to reflect the user's particular pool requirements. Alternatively, the time clock can be factory-set for a period of from about 1.5 to 3 minutes. If the mercury switch changes position the time clock stops its count-down and/or a delay circuit is activated to allow time for the cleaner to climb the sidewall of the pool, e.g., about 5-10 seconds. At the end of the delay period, the drive motor is stopped and/or reversed to move the cleaner down the wall. In the event the timer reaches the prescribed time period without receiving a signal from the mercury switch, a signal is transmitted to stop and/or reverse to drive motor. If the cleaner has been immobilized by an obstacle, this timed auto-reversing of the drive motor will move the cleaner away from the obstacle to resume its scanning or random motion cleaning pattern.

Power Shut-off

The method and apparatus of the invention also comprehends the use of a power shut-off circuit that is responsive to a signal or force that corresponds to a magnetic field. In one preferred embodiment, a magnet or magnetic material is formed as, incorporated in, or attached to a movable element that forms part of the cleaner, e.g., a non-driven supporting wheel or an auxiliary wheel that is in contact with the pool surface on which the cleaner is moving. One suitable device is a reed switch that is maintained in a closed position (e.g., passing power to the pump motor) so long as the adjacent magnet is moving past at a specified rotational speed, or rpm. If the rotation of the magnet stops, as when the cleaner's advance is stopped by encountering a sidewall of the pool, the reed switch opens and the power to the drive motor is interrupted. In a preferred embodiment, the circuit includes a reversing function so that the cleaner resumes movement in the opposite direction and the reed switch is closed to complete the power circuit until the unit again stops, e.g., at the opposite wall.

In a further specific and preferred embodiment of the invention, the cleaner is provided with an impeller that is rotatable in response to movement through the water. One or more of the impeller blades and/or mounting shaft is provided with or formed from a magnetic material. A sensor is mounted proximate the path of the moving magnet and an associated circuit is responsive to the signal generated by the sensor due to the movement, or absence of movement, of the magnet. In one preferred embodiment, the magnetic sensor circuit is incorporated in the cleaner IC device that electronically controls the pump motor, so that when the cleaner's movement is halted by a vertical side wall, the movement of the impeller and associated magnetic material also ceases and the sensor sends a signal through the circuit to interrupt power to the pump motor. After a predetermined delay period, the pump motor can be reactivated, in either the same or the reverse direction, to cause the unit to move away from the wall. The same circuit can be employed to control a drive motor that propels the drive train for wheel, track or roller mounted cleaners.

In another embodiment, the cleaner is provided with an infrared ("IR") light device that includes an IR source and sensor and related control circuit that is responsive to a static position of the cleaner adjacent a side wall of the pool or tank. When the returned IR light indicates a static position the circuit transmits a signal that results in the reverse movement of the cleaner.

In a further preferred embodiment, the electric or electronic controller circuit of the cleaner includes an "air sensor" switch that sends a signal or otherwise directly or indirectly interrupts the flow of water stream W when the sensor emerges from the water. In one preferred embodiment the sensor is a pair of float switches, one located at either end of the cleaner. When the cleaner climbs the vertical sidewall of the pool, and the end with the air sensor emerges from the water line, water drains from the float chamber and the switch is activated to either directly interrupt the flow of electrical power to the pump motor, or to send a signal to the IC controller to effect the immediate or delay interruption of power to the pump motor. The same sequence of events occurs during operation of an in-ground pool of the "beach" type design, where one end has a sloping bottom or side that starts at ground level. Once the forward end of the moving cleaner emerges from the water, the flow of water is interrupted for a brief time and then resumed in the opposite direction to propel the unit down the slope to continue its scanning pattern.

As will be understood from the preceding description and from that which follows, this aspect of the invention comprehends various alternative means for interrupting the flow of the water jet. For example, if the pressurized water stream is delivered via hose 152 from a source external to the cleaner, e.g., the pool's built-in filter pump, an electromechanical bypass valve (not shown) located adjacent the hose fitting at the sidewall of the pool can be activated for a predetermined period of time to divert the flow of water from the hose directly into the pool. When the flow of water W is interrupted, the flap valve 46 of valve assembly 40 changes position and the cleaner reverses direction when the flow W is resumed.

As will be understood by one of ordinary skill in the art, the means of generating signals directed to the control circuit can also be combined. For example, an air sensor of the float type can be combined with, or fabricated from a magnetic material and installed proximate a magnetic sensor so that a change in position of the float when it is no longer immersed in water produces a signal in the magnetic sensor circuit.

The flow of water W can also be interrupted by a water-driven turbine timer having a plurality of pre-set or adjustable timing sequences. For example, a water-powered cam or step-type timer in combination with a by-pass or diverter valve located downstream is installed on the hose 152 from the external source of pressurized water. As water flows through the hose, the timer mechanism is advanced to a position at which the associated by-pass valve is actuated and the flow is diverted into the pool for a predetermined period of time. The turbine timer then advances to the next position at which the by-pass valve moves to the main flow position to redirect water to the cleaner, which now moves in the opposite direction. In this embodiment, the by-pass/diverter valve can comprise an adjustable pinch valve that compresses the hose to interrupt flow to cleaner 10.

In another preferred embodiment, the rpms of the pump and/or drive motor are monitored and if the rpm decreases below a certain minimum, as when the impeller is jammed by a piece of debris that escaped the filter, the power to the pump motor is interrupted. If the rpms exceed a maximum, as when the unit is no longer submerged and the motor is running under a no-load condition, the power is interrupted to both pump and drive motors. This will constitute an important safety feature, where the cleaner is turned on while it is not in the pool, either by inadvertence, or by small children playing with the unit.

What is claimed is:

1. A self-propelled cleaning apparatus for cleaning a sub-merged surface of a pool, comprising:

a housing including a front portion, a rear portion substantially opposite the front portion, and first and second side portions disposed between the front and rear portions;

a first support rotationally mounted to the first side portion and a second support rotationally mounted to the second side portion, wherein a rotational axis of the first support is substantially aligned with a rotational axis of the second support;

at least one inlet and at least one outlet;

at least one filter disposed in an interior of the housing, wherein the filter is in fluid communication with the at least one inlet; and an electric water pump disposed in the interior of the housing, the water pump configured to establish a flow path through at least a portion of the housing by drawing water and debris from the pool into the housing through the at least one inlet, directing water through the at least one filter, and discharging filtered water out of the housing to the pool through the at least one outlet;

wherein the at least one outlet is configured to direct a pressurized stream of water at an acute angle with respect to the surface over which the apparatus moves.

2. The apparatus of claim 1, further including a third support rotationally mounted to the first side portion and a fourth support rotationally mounted to the second side portion.

3. The apparatus of claim 2, wherein the first, second, third, and fourth supports are wheels.

4. The apparatus of claim 1, wherein the first and second supports are wheels.

5. The apparatus of claim 1, wherein the first and second supports are mounted on a common axle.

6. The apparatus of claim 1, wherein the first and second supports are mounted on separate axles.

7. The apparatus of claim 1, wherein the at least one outlet includes a longitudinal axis disposed at a fixed acute angle with respect to the surface over which the apparatus moves.

8. The apparatus of claim 1, wherein the outlet includes a longitudinal axis disposed at a fixed acute angle with respect to the rotational axis of the first support and the rotational axis of the second support.

9. The apparatus of claim 1, wherein the outlet is a port in the housing.

10. The apparatus of claim 1, wherein the filter is disposed fluidly upstream of the outlet in the water flow path.

11. The apparatus of claim 1, wherein the filter is disposed fluidly downstream of the at least one inlet and fluidly upstream of the at least one outlet in the water flow path.

12. A self-propelled cleaning apparatus for cleaning a sub-merged surface of a pool, comprising:

a housing defining an interior;

a first wheel rotationally mounted to a first portion of the housing and a second wheel rotationally mounted to a second portion of the housing, the first and second wheels at least partially supporting the housing relative to a surface of the pool over which the apparatus moves, wherein a rotational axis of the first wheel is substantially aligned with a rotational axis of the second wheel;

an inlet disposed in a portion of the housing adjacent a surface over which the apparatus moves;

an outlet;

a filter disposed in the interior of the housing;

an electric pump disposed in the interior of the housing, the pump configured to draw water and debris into the interior of the housing through the inlet, draw water and debris into the filter, draw filtered water out the filter, and discharge the filtered water through the outlet;

wherein the outlet includes a longitudinal axis disposed at a fixed acute angle with respect to the surface over which the apparatus moves and is configured to direct a pressurized stream of water.

13. The apparatus of claim 12, wherein the first and second wheels are mounted on a common axle.

14. The apparatus of claim 12, wherein the first and second wheels are mounted on separate axles.

15. The apparatus of claim 12, wherein the outlet is a port in the housing.

* * * * *